US007048176B2

(12) United States Patent
Littlejohn et al.

(10) Patent No.: US 7,048,176 B2
(45) Date of Patent: May 23, 2006

(54) DEEP DISH DISPOSABLE CONTAINER

(75) Inventors: Mark B. Littlejohn, Appleton, WI (US); Georganne Shirk, New York, NY (US); Albert D. John, Saylorsburg, PA (US)

(73) Assignee: Fort James Corporation, Atlanta, GA (US)

( * ) Notice: Subject to any disclaimer, the term of this patent is extended or adjusted under 35 U.S.C. 154(b) by 506 days.

(21) Appl. No.: 09/978,484

(22) Filed: Oct. 17, 2001

(65) Prior Publication Data

US 2002/0113118 A1 Aug. 22, 2002

Related U.S. Application Data

(60) Provisional application No. 60/243,822, filed on Oct. 27, 2000.

(51) Int. Cl.
*B65D 1/00* (2006.01)

(52) U.S. Cl. ..... 229/406; 220/574

(58) Field of Classification Search ..... 229/407, 229/406; 162/175, 181.8, 181.1, 174; 270/220, 270/574

See application file for complete search history.

(56) References Cited

U.S. PATENT DOCUMENTS 4,606,496 A 8/1986 Marx et al.
4,609,140 A 9/1986 Van Handel et al.
4,721,499 A 1/1988 Marx et al.
4,721,500 A 1/1988 Van Handel et al.
4,781,566 A 11/1988 Rossi et al.
4,832,676 A 5/1989 Johns et al.
5,088,640 A 2/1992 Littlejohn
5,203,491 A 4/1993 Marx et al.
5,249,946 A 10/1993 Marx
5,326,020 A 7/1994 Cheshire et al.
5,876,815 A 3/1999 Sandstrom et al.
5,887,781 A 3/1999 Marx et al.
5,938,112 A * 8/1999 Sandstrom ..... 229/407
6,592,357 B1 7/2003 Johns et al.

* cited by examiner

*Primary Examiner*—Tri M. Mai
(74) *Attorney, Agent, or Firm*—Jacqueline M. Hutter

(57) ABSTRACT

A deep dish disposable container is preferably prepared from a radially scored paperboard blank and has a substantially planar bottom portion, an upwardly projecting sidewall portion and an outwardly extending flange portion. The flange and sidewall are provided with a plurality of circumferentially spaced, radially extending densified regions formed from a plurality of paperboard layers reformed into substantially integrated fibrous structures generally inseparable into their constituent layers having a thickness generally equal to adjacent areas of the sidewall and flange portions to provide uniformity and strength. The deep dish container generally has a height to diameter ratio of from about 0.1 to about 0.16; whereas the radially scored paperboard blank has from about 50 to about 100 radial scores. The product is dimensioned and configured such that there is from about 0.015 to about 0.05 inches of excess paperboard per score about the flange portion in order to provide rigidity to the product.

74 Claims, 12 Drawing Sheets

DEEP DISH DISPOSABLE CONTAINER

CLAIM FOR PRIORITY

This non-provisional application claims the benefit of the filing date of U.S. Provisional Patent Application Ser. No. 60/243,822, of the same title, filed Oct. 27, 2000.

TECHNICAL FIELD

The present invention relates to disposable food containers, but is particularly directed to a disposable paper food container having a relatively large central planar portion as a plate has, as well as a relatively high sidewall for a given container diameter. The inventive articles are particularly useful for containing food including components that tend to be wet or messy, such as spaghetti, pasta dishes, stews, casseroles, salads, meat and gravy combinations and so forth, where spillage is sometimes a problem. The inventive articles are particularly suitable for individual use.

BACKGROUND

Disposable paper food containers are well known. Typically, such articles are made by way of pulp-molding processes or by way of pressing a planar paperboard blank in a matched metal heated die set. Illustrative in this regard are U.S. Pat. No. 4,606,496 entitled "Rigid Paperboard Container" of R. P. Marx et al; U.S. Pat. No. 4,609,140 entitled "Rigid Paperboard Container and Method and Apparatus for Producing Same" of G. J. Van Handel et al; U.S. Pat. No. 4,721,499 entitled "Method of Producing a Rigid Paperboard Container" of R. P. Marx et al; U.S. Pat. No. 4,721,500 entitled "Method of Forming a Rigid Paper-Board Container" of G. J. Van Handel et al; U.S. Pat. No. 5,088,640 entitled "Rigid Four Radii Rim Paper Plate" of M. B. Littlejohn; U.S. Pat. No. 5,203,491 entitled "Bake-In Press-Formed Container" of R. P. Marx et al; and U.S. Pat. No. 5,326,020 entitled "Rigid Paperboard Container" of J. O. Chesire et al.

Equipment and methods for making paperboard containers are also disclosed in U.S. Pat. Nos. 4,781,566 entitled "Apparatus and Related Method for Aligning Irregular Blanks Relative to a Die Half" of A. F. Rossi et al; U.S. Pat. No. 4,832,677 entitled "Method and Apparatus for Forming Paperboard Containers" of A. D. Johns et al; and U.S. Pat. No. 5,249,946 entitled "Plate Forming Die Set" of R. P. Marx et al.

The disclosure of the foregoing patents is hereby incorporated by reference to this application. The present invention is directed to a novel shaped, rigid and strong disposable paperboard pressware container having a profile intermediate a disposable paper plate and a disposable paper bowl.

SUMMARY OF THE INVENTION

There is thus provided in one aspect of the present invention a rigid and strong, deep dish disposable container prepared from a radially scored paperboard blank having a substantially planar bottom portion, an upwardly projecting sidewall joined thereto and an outwardly extending flange portion joined to the sidewall portion. The upwardly extending sidewall portion and the outwardly extending flange portion are provided with a plurality of circumferentially spaced radially extending densified regions formed from a plurality of paperboard layers reformed into substantially integrated fibrous structures extending along at least a portion of the length occupied by the scores of the paperboard blank having a thickness generally equal to adjacent areas of the sidewall and flange portions. The scores are most preferably of uniform length. The container is provided with a height to diameter ratio of from about 0.1 to about 0.16. The radially scored paperboard blank typically has from about 50 to about 100 radial scores and preferably from about 60 to about 90 radial scores. About 75 radial scores is suitable for a 9½ inch deep dish container having a height of about 1.25 inches. Generally the paperboard blank has scores with widths of from about 0.010 to about 0.050 inches. A width of about 0.03 inches is typical. The paperboard may be scored on either its coated topside surface or on its backside surface.

In general, the container has from about 0.015 inches to about 0.05 inches excess paperboard per score about its flange portion. From about 0.025 to about 0.04 inches of excess paperboard about its flange portion is typical. A container having a diameter of about 9½ inches may suitably have about 0.03 inches of excess paperboard about its flange portion. The amount of excess paperboard may also be defined as from about 50 percent to about 175 percent excess paperboard per score about the flange of the container; with from about 90 percent to about 140 percent excess paperboard per score about the flange being typical. About 100 percent excess paperboard per score about the flange of the container is particularly preferred for a deep dish paperboard container formed in accordance with the present invention in many embodiments.

The deep dish disposable container in accordance with the present invention most typically has a height to diameter ratio of from about 0.125 to about 0.135.

Scores in the paperboard blank suitably extend from the outer periphery of the upper portion of the sidewall inwardly and downwardly over at least about 50 percent of the height of the container and terminate at a level substantially above the substantially planar bottom portion of the deep dish disposable container. In some embodiments, the scores in the paperboard blank extend from the upper portion of the sidewall downwardly over at least about 75 percent of the height of the container and terminate at a level substantially above the substantially planar bottom portion of the container, preferably at a level of from about 0.15 inches to about 0.3 inches or so above the container bottom.

In another aspect of the present invention, there is provided a method of making a deep dish disposable container including the steps of:

a) radially scoring paperboard stock to define from about 50 to about 100 scores provided with score widths of from about 0.010 inches to about 0.050 inches (10 to 50 mils);
b) preparing a scored paperboard blank from said paperboard stock geometrically on center with respect to the score pattern of the paperboard stock;
c) transferring and positioning said radially scored paperboard blank in a heated pressware die set;
d) heat-pressing said radially scored paperboard blank with said die set into said deep dish container wherein said deep dish disposable container has a substantially planar bottom portion, an upwardly extending sidewall portion and an outwardly extending flange portion and is provided with a height to diameter ratio of from about 0.1 to about 0.16 and wherein said deep dish disposable container is provided with excess paperboard in suitable amounts to provide for densified areas which impart strength and rigidity to said deep dish disposable container; and e) removing said deep dish disposable container from said heated pressware die set.

The paperboard blank typically has a basis weight of from about 140 lbs. to about 250 lbs. per 3000 square foot ream; whereas from about 175 to about 225 lbs. per 3000 square foot ream is typical.

A particularly preferred method involves scoring the paper blanks using a press provided with a plurality of opposing rules and channels, wherein the channels are wider than the rule widths by about two paperboard thicknesses and the score rules deform the paperboard into the channels thereby departing U-shaped geometries and internally delaminating the paperboard fibers such that U-shaped pleats are promoted in the deep dish container. So also, the paperboard blank is preferably positioned using a plurality of rotating pin blank stops disposed at the periphery of the pressware die set and substantially perpendicular to the forming surfaces.

In general the deep dish disposable container includes a substantially planar bottom portion, an upwardly extending sidewall integrally formed with the substantially planar bottom, and a flange portion projecting outwardly from the upper extremity of the sidewall wherein the upwardly extending sidewall defines an angle of from about 10° to about 40° from a vertical perpendicular to the substantially planar bottom portion and the outwardly projecting flange portion defines an angle of from about −10° to about +15° with a horizontal parallel to the substantially planar bottom portion and wherein further the deep dish disposable container has a height to diameter ratio of from about 0.1 to about 0.16. Typically the angle that the upwardly projecting sidewall defines with a vertical to the substantially planar bottom portion of the container is about 30° whereas the angle defined by the outwardly projecting flange portion of the container with a horizontal parallel to the substantially planar bottom portion of the container is about 5°. When referring to the angle defined by the outwardly projecting flange portion with a horizontal parallel to the bottom, a positive value herein indicates a downwardly sloping flange whereas a negative value refers to an upwardly and outwardly sloping flange. As will be appreciated from FIG. 4, a value of 5.5° for A3 indicates a slightly downwardly sloping flange.

In a particularly preferred embodiment the substantially planar bottom portion is joined to the upwardly extending sidewall by way of a first arcuate transition section defining a first radius of curvature, wherein the ratio of the first radius of curvature to the diameter of the deep dish disposable container is from about 0.035 to about 0.075. Typically this ratio is about 0.05 in some embodiments.

In still yet other embodiments, the upwardly extending sidewall is joined to the flange portion by way of a second arcuate transition section defining a second radius of curvature wherein the ratio of the second radius of curvature to the diameter of the deep dish disposable container is from about 0.015 to about 0.045. In particularly preferred embodiments the container further includes a lip portion joined to the flange portion and extending downwardly therefrom.

BRIEF DESCRIPTION OF DRAWINGS

The invention is described in detail below with reference to the figures wherein like numbers designate similar parts and wherein.

DETAILED DESCRIPTION

Figure 1A:
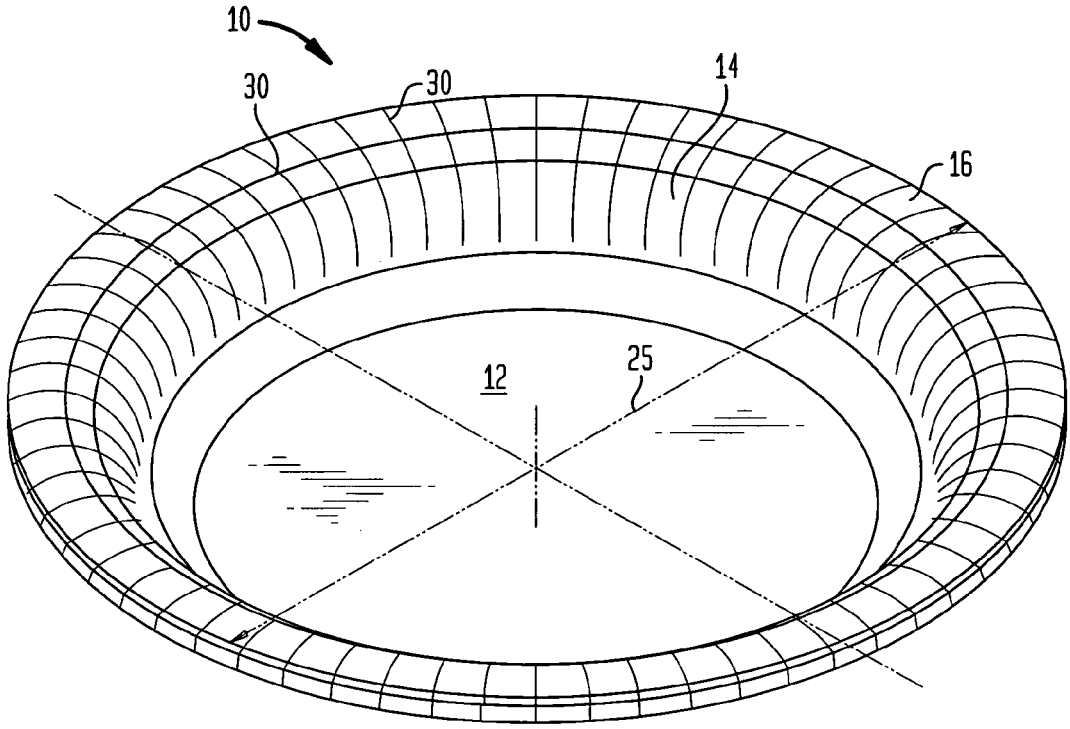
FIG. 1A is an isometric view of a deep dish disposable container of the present invention.
Figure 1B:
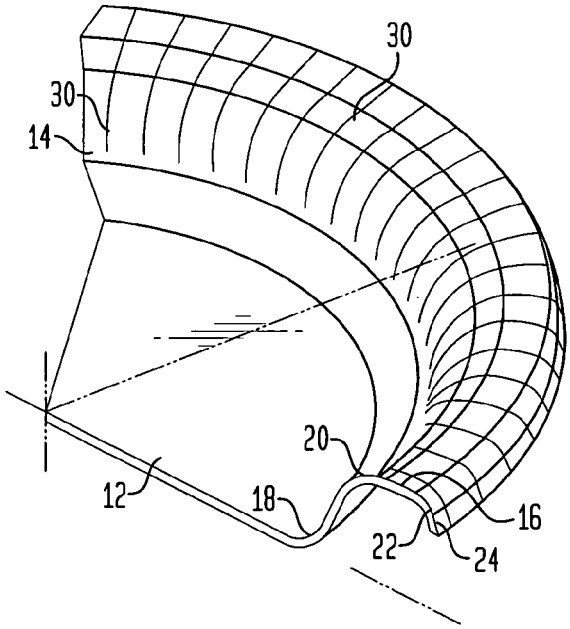
FIG. 1B is a detail of the deep dish disposable container of FIG. 1A.
Figure 2A:
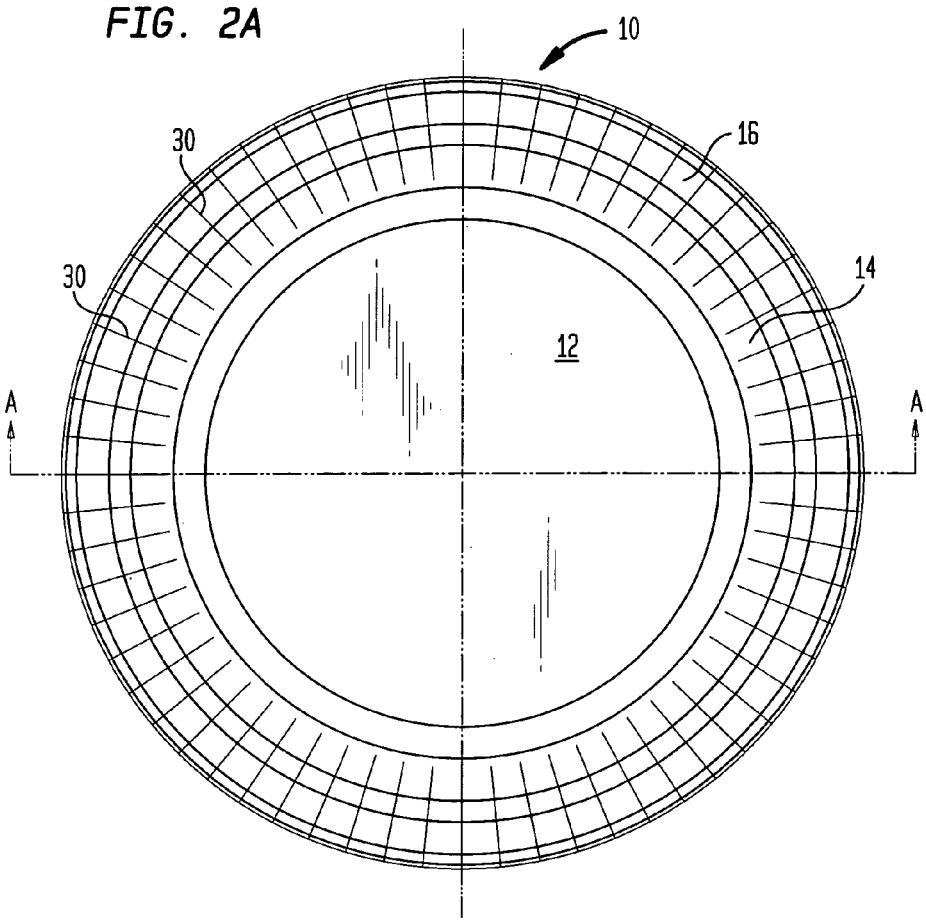
FIG. 2A is a top view of the deep dish disposable container of FIG. 1A.
Figure 2B:
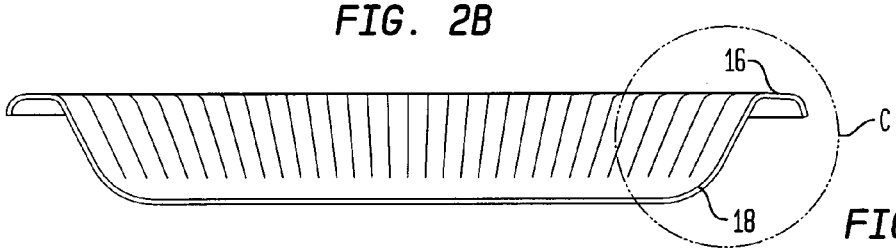
FIG. 2B is a view in elevation and section along line A—A of the deep dish disposable container of FIG. 2A.
Figure 2C:
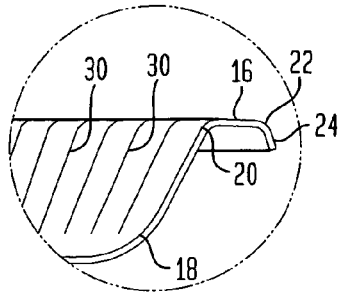
FIG. 2C is a detail illustrating the sidewall and rim of the deep dish disposable container of FIG. 2B.

The present invention is described in detail below with respect to particular embodiments. Such disclosure is for purposes of exemplification only. Various modifications within the spirit and scope of the present invention, set forth in the appended claims, will be readily apparent to those of skill in the art. This invention is directed to disposable deep dish pressware paperboard containers having a profile that is intermediate between that of a paper plate (lower height and shallower) and a bowl (higher height and deeper). The deep dish container of the present invention is especially suitable for use with foods such as spaghetti, pasta dishes, stews, casseroles, salads, meat and gravy and so forth, where a higher sidewall is desired to more readily contain food while still providing a plate like appearance for esthetics and food presentation. The deep dish container is designed with a profile that provides a rigid structure per given paperboard material usage allowing for economics acceptable for disposable products. A specialized matched-metal pressware forming process is used for the deep dish container conversion that includes radial scoring of the paperboard stock. The number of scores, and the length of the scores is designed to provide the most uniform material gathering, maximize container rigidity and provide for acceptable esthetics while minimizing cut-score (pleat crack) tendency. Die set features, such as articulated punch knock-outs, rotating blank pin stops and cast heaters may be advantageously employed during formation of the inventive products.

The pressware deep dish product may be formed from a flat paperboard blank that is scored. The blank will be drawn into a matched-metal die set consisting of die and punch halves having upper and lower knock-outs, draw rings and pressure rings in a manner to uniformly gather paperboard around the product's circumference into folds or pleats. The folds or pleats must occur since the initial blank diameter is larger than the final formed deep dish container diameter, especially at the outer portions. The determination of the correct number of scores and resulting pleats must be such that there is not too little or too much paperboard per fold.

Each of the scores is commonly produced with a two point rule, that is 0.028 inches wide (1 point equals 0.014 inches). A score is intended to internally delaminate the paperboard fibers and create a radial line of weakness that will focus the paperboard gathering into it. The U-shape geometry of the score may also affect the gathering during product formation. Each score line and resulting fold is a potential hinge if not repressed or "bonded" into a pressed pleat. Score rules can vary from one point (0.014 inches) and 3 point (0.042 inches) widths while less common are also possible. Scores may be topside or backside applied to the paperboard relative to the coated paperboard topside with similar results as described above.

Items considered in determining the desired number and length of the score rules to form the deep dish container may be summarized as follows:

a) the amount of paperboard to be gathered into each score should be greater than the score rule width (greater than 0.028 inches if a two point rule is used) or the geometry of the score in the resulting press pleat will most likely allow local radial hinging and result in a lower rigidity container;

b) an excess amount of paperboard gathering is desired into each score to allow for some resistance during the pressing, pleat formation and rebonding process. Preferably the resulting fold prior to pressing can be characterized as "U-shaped". An excess amount of paperboard per score varies along the entire container profile with less at the inner most end of the score and the most at the outer diameter of the product. Excess material amounts of from 0.015 inches to 0.050 inches are typically desired for plates and bowls at the flange portion of the products. The number of scores is determined to obtain the desired amount of excess paperboard per fold;

c) the length of each individual score is also preferably such that when the blank is formed into the container the end of the score or pleat should be towards the lower sidewall of the container and slightly above the near planar container bottom;

d) the score needs to be slightly above the container bottom so that if the paperboard gathering into the score does not completely fill its gap, water, grease, and oils are not absorbed into the paperboard. Scoring can sometimes damage the functional top coating and if the paperboard and coating does not fill the score gap and become repressed, absorption and possible leakage through the paperboard can occur. The score may be terminated approximately 0.150 inches to about 0.3 inches vertically above the container bottom to minimize chances of this type of failure;

e) if the inner most score occurs too far vertically in the sidewall area, it may not provide adequate paperboard gathering and control during the pressware container formation. Paperboard will begin gathering into folds beginning at the outer edge of the near planar bottom or near the beginning of the lower radius joining the sidewall to the bottom. When the score ends are located too far away from this location, the paperboard folds may occur randomly around the container circumference resulting in too little paperboard in many folds and pleats and too much paperboard in others; and f) too much paperboard in a given score, pleat, can result in poor visual esthetics, variation in pleat uniformity and possibly cut-scoring during the pressing. Cut-scoring during the formation can result in pleat failure/cracking during subsequent use and flexing. It is also possible that fold with too much paperboard may resist pressing and will require more pressing force possibly resulting in less pleat bonding and a lower rigidity product.

Referring to FIGS. 1A–4 and Table 1 below, there is illustrated an embodiment of a deep dish disposable container of the invention as well as relative dimensions which may be used for making other size and shape containers of the inventive proportions. A deep dish container 10 includes a substantially planar bottom portion 12, an upwardly and outwardly extending sidewall portion 14 as well as a flange portion 16. The substantially planar bottom portion is joined to sidewall 14 by way of a first arcuate transition section 18 whereas the sidewall is joined to flange 16 by way of a second arcuate transition section 20. In a particularly preferred embodiment there is further provided a third arcuate transition section 22 and a downwardly extending lip 24. Deep dish container 10 may have a diameter 25 of about 9.59 inches or so.

The containers of the present invention are most preferably made from scored paperboard stock. Inasmuch as the paperboard blanks are planar or substantially planar, a significant amount of paperboard must be taken up into folds or pleats about the sidewall and flange of the containers where the circumference of the deep dish container is significantly less than the corresponding circumference of the paperboard container from which the article was made. There is accordingly provided about the sidewall and flange portions of the invention containers a plurality of pleats 30, which are commonly evenly spaced and preferably uniform as further described hereinafter.

Figure 3:
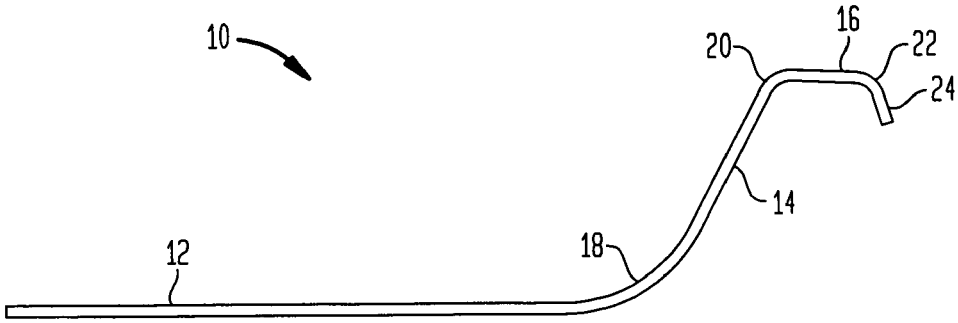
FIG. 3 is a schematic profile of the deep dish disposable container of FIGS. 1A–2C.

The various proportions of the deep dish container of the invention are perhaps best seen in FIG. 3 which is a schematic profile from the centerpoint of container 10 to its outer periphery. The relative proportions are better understood by reference to FIG. 4 and Table 1 below.

Figure 4:
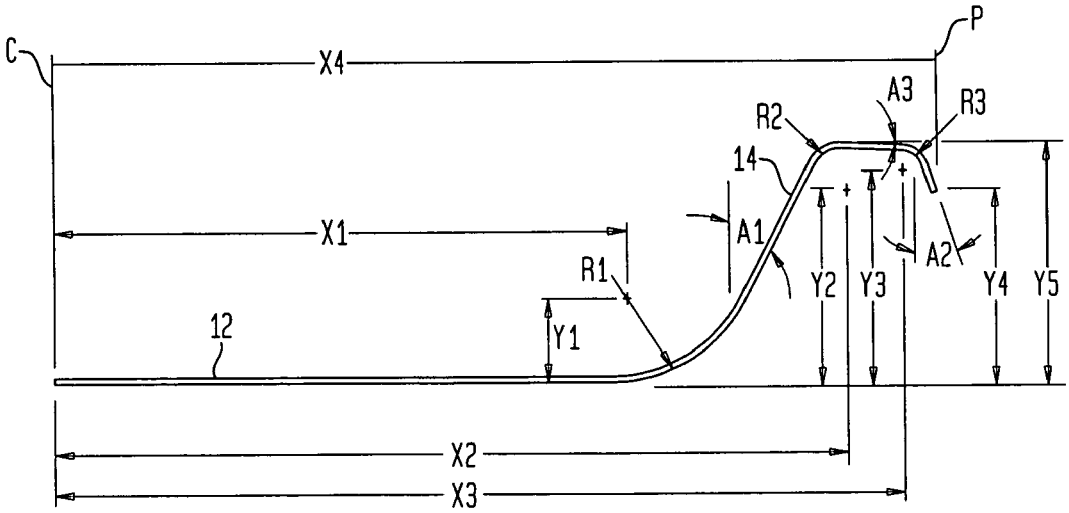
FIG. 4 is a schematic diagram showing the relative dimensions of the profile of the deep dish container of FIGS. 1A–3.

FIG. 4 is a schematic diagram showing the profile of a deep dish container of the invention starting at its centerpoint C (and continuing to the outer periphery, P, as shown. FIG. 4 is the same profile as FIG. 4, where only portions 12 and 14 are indicated. For a round container, the radius, X4, is equal to 0.5D. For other shaped containers, and for scaling purposes, the diameter to use may be the average diameter, that is, (length+width)/2, for a rectangular container and so forth for other container shapes. Characteristic horizontal distances and radii shown in FIG. 4 include X4, the radius of the product; X1, the horizontal distance from the center of the product to the origin of R1 which is the radius of curvature defined by arcuate transition section 18; X2, which is the horizontal distance from the centerpoint of the product to the origin of radius R2, which is the radius of curvature defined by second arcuate transition section 20; and X3, which is the distance from the center of the product to the origin of R3, which is the radius of curvature defined by third arcuate transition section 22. Characteristic vertical distances and angles include Y1, which is the height of the origin of R1 above substantially planar bottom portion 12; Y2, which is the height of the origin of R2 above substantially planar bottom portion 12; Y3, which is the height of origin R3 above substantially planar bottom portion 12; Y4, which is the height above substantially planar bottom portion 12 of the lowermost portion of lip 24 and Y5, which is the height of the container. The dimensions Y1, Y2, Y3, Y4, Y5, R1, R2, R3 are measured from the bottom surface or "die side" of the container. Various angles defined include A1, which is the angle generally defined between a vertical (perpendicular to 12) and sidewall 14; angle A2, which is generally the angle between a vertical and lip 24 and angle A3, which is the angle defined generally by flange portion 16 and a horizontal line (that is a line parallel to bottom substantially planar portion 12). A positive value for A3 indicates a downwardly sloping flange, as noted above.

While a particularly preferred deep dish disposable container has a diameter of about 9.6 inches, the relative proportions of the container illustrated in FIGS. 1A to 4 may also have the relative values and angles listed in Table 1 over the ranges indicated. As will be appreciated by one of skill in the art, the deep dish disposable container has a profile intermediate a bowl and plate.

TABLE 1

| DIMENSION RATIO OR | VALUES (Dimensionless or degrees) | | |
|---|---|---|---|
| ANGLE | PREFERRED | MINIMUM | MAXIMUM |
| R1/D | 0.055 | 0.035 | 0.075 |
| X1/D | 0.334 | 0.265 | 0.405 |
| Y1/D | 0.055 | 0.040 | 0.070 |
| R2/D | 0.025 | 0.015 | 0.045 |
| X2/D | 0.450 | 0.380 | 0.485 |

TABLE 1-continued

| DIMENSION RATIO OR | VALUES (Dimensionless or degrees) | | |
|---|---|---|---|
| ANGLE | PREFERRED | MINIMUM | MAXIMUM |
| Y2/D | 0.106 | 0.075 | 0.135 |
| R3/D | 0.009 | 0.003 | 0.020 |
| X3/D | 0.488 | 0.420 | 0.495 |
| Y3/D | 0.118 | 0.090 | 0.150 |
| X4/D | 0.500 | ** | ** |
| Y4/D | 0.111 | 0.085 | 0.140 |
| Y5/D | 0.130 | 0.100 | 0.160 |
| A1 | 27.48° | 10.00° | 40.00° |
| A2 | 22.50° | 10.00° | 35.00° |
| A3 | 5.50° | −10.00° (Upward Angle) | 15.00° |

**X4/D = 0.500 if round container

Some preferred embodiments of the invention are characterized by dimensions about the flange and downwardly extending lip portion of the rim which provide rigidity and ease of handling of the inventive deep dish, making the container especially suitable for individual use. A relatively broad and rigid rim of the container provides for secure grasping by a user. The ratio of the length of the downwardly extending lip portion to the diameter of the product is typically from about 0.01 to about 0.030. The horizontally extending flange and rim portion generally has a characteristic flange width to diameter ratio of at least about 0.04; typically up to about 0.12. A characteristic width to diameter ratio, $(X_4-X_2)/D$ in Table 1 above, is perhaps most preferably about 0.05. The characteristic flange width to diameter ratio is calculated by taking the difference between the product outermost radius from the centerpoint ($X_4$) and the horizontal distance from the centerpoint of the product to the origin of the radius of curvature of the arcuate region joining the sidewall and flange ($X_2$) and dividing the difference by the diameter of the product to determine the ratio.

Figure 5A:
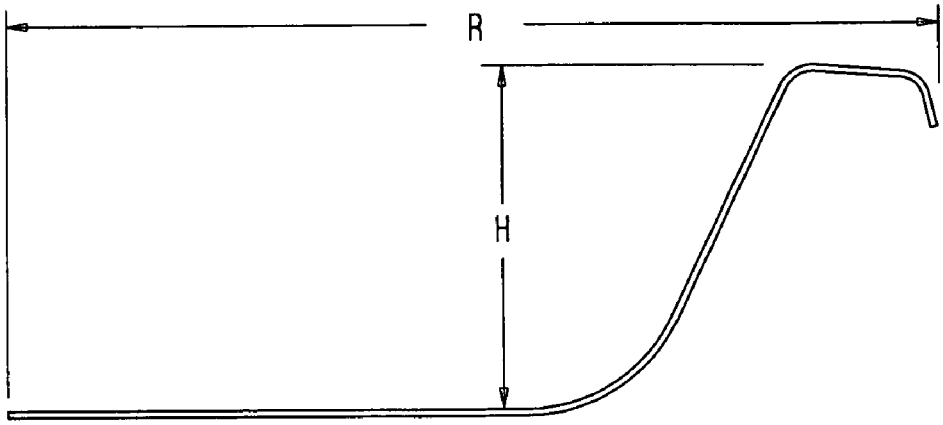
FIGS. 5A–5C are diagrams showing the relative profiles of a bowl, a deep dish disposable container of the present invention and a plate all made with a paperboard blank of the same diameter.
Figure 5B:
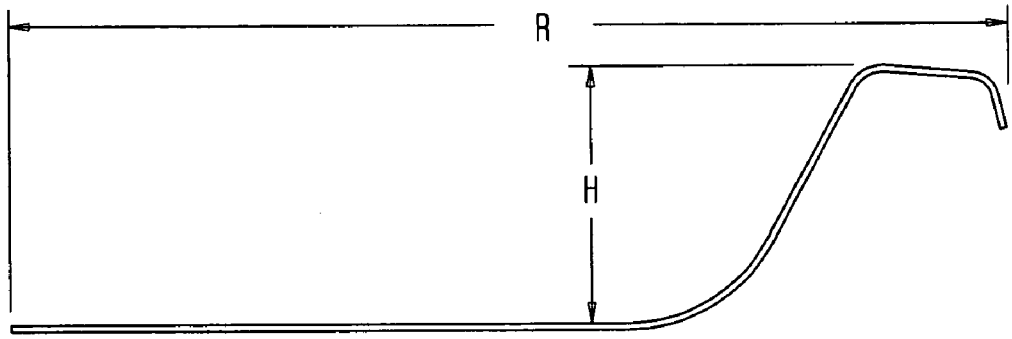
Figure 5C:
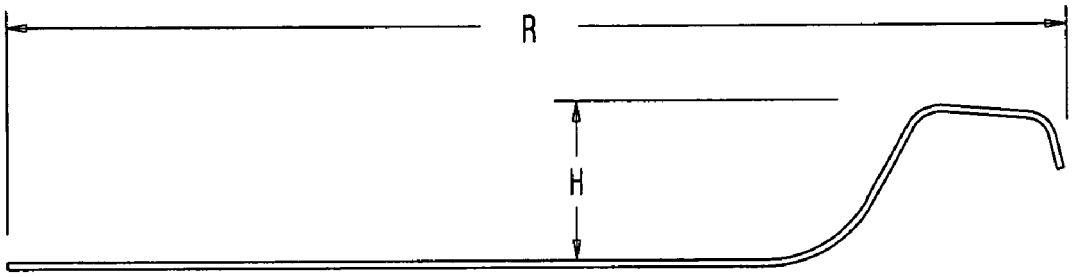

The inventive deep dish containers of the present invention are further appreciated by comparison with, for example, conventional paper plates and bowls of profiles having some of the same features and which can be made from the same size paperboard blank. FIGS. 5A–5C are schematic diagrams showing respectively a 34 ounce bowl made from an 11.09 inch diameter circular paperboard blank, a deep dish container made from an 11.09 inch diameter circular paperboard blank and 10 inch plate made from the same 11.09 inch diameter paperboard blank. It is seen from the diagrams that the deep dish container has outer radius and sidewall height intermediate the bowl and plate. The relevant features are summarized in Table 2 below.

TABLE 2

Container Profile Comparisons

| Article | Paperboard Blank Diameter (inches) | Radius (inches) | Height (inches) |
|---|---|---|---|
| 34 oz. Bowl | 11.09 | 4.484 | 1.679 |
| Deep Dish Container | 11.09 | 4.794 | 1.250 |
| 10" plate | 11.09 | 5.082 | 0.795 |

It will be further appreciated that inasmuch as the deep dish container is fabricated from a planar or flat paperboard blank, the blank used to form the container has a substantially larger circumference than the formed product at the outward portions of the dish as is illustrated in Table 3. In Table 3, the paperboard takeup at a given circumference of the deep dish container is determined as the difference between the circumference of the product and the corresponding circumference of the blank from which the container was made and may be expressed as:

$$\text{Board Takeup}=(\text{Corresponding Blank Radius}-\text{Product Radius})\times 2\pi$$

TABLE 3

Board Takeup Calculation

| CORRESPONDING BLANK RADIUS FROM CENTER (IN) | DEEP DISH RADIUS (IN) | TOTAL CIRCUMFERENTIAL BOARD TAKEUP (IN) |
|---|---|---|
| 0.000 | 0.000 | 0.000 |
| 0.250 | 0.250 | 0.000 |
| 0.500 | 0.500 | 0.000 |
| 0.750 | 0.750 | 0.000 |
| 1.000 | 1.000 | 0.000 |
| 1.250 | 1.250 | 0.000 |
| 1.500 | 1.500 | 0.000 |
| 1.750 | 1.750 | 0.000 |
| 2.000 | 2.000 | 0.000 |
| 2.250 | 2.250 | 0.000 |
| 2.500 | 2.500 | 0.000 |
| 2.750 | 2.750 | 0.000 |
| 2.799 | 2.799 | 0.000 |
| 2.899 | 2.899 | 0.000 |
| 2.999 | 2.999 | 0.000 |
| 3.099 | 3.099 | 0.000 |
| 3.199 | 3.199 | 0.000 |
| 3.299 | 3.298 | 0.006 |
| 3.399 | 3.394 | 0.031 |
| 3.499 | 3.483 | 0.101 |
| 3.599 | 3.562 | 0.232 |
| 3.699 | 3.627 | 0.452 |
| 3.699 | 3.627 | 0.452 |
| 3.799 | 3.678 | 0.760 |
| 3.899 | 3.724 | 1.100 |
| 3.999 | 3.770 | 1.439 |
| 4.099 | 3.817 | 1.772 |
| 4.125 | 3.829 | 1.860 |
| 4.125 | 3.829 | 1.860 |
| 4.199 | 3.863 | 2.111 |
| 4.299 | 3.909 | 2.450 |
| 4.399 | 3.955 | 2.790 |
| 4.499 | 4.001 | 3.129 |
| 4.599 | 4.047 | 3.468 |
| 4.699 | 4.093 | 3.808 |
| 4.799 | 4.150 | 4.078 |
| 4.899 | 4.235 | 4.172 |
| 4.999 | 4.334 | 4.178 |
| 5.099 | 4.433 | 4.185 |
| 5.199 | 4.533 | 4.185 |
| 5.299 | 4.633 | 4.185 |
| 5.399 | 4.728 | 4.216 |
| 5.499 | 4.776 | 4.543 |
| 5.547 | 4.794 | 4.731 |

Figure 6A:
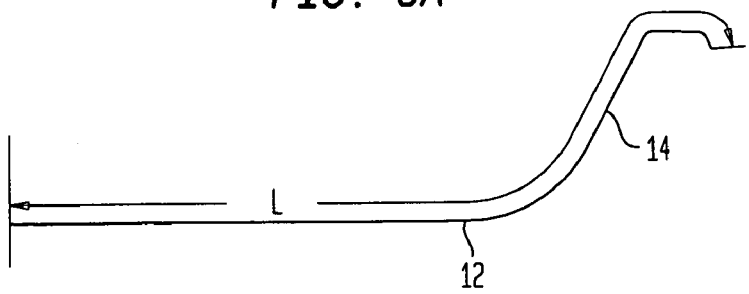
FIGS. 6A–6C are schematic diagrams showing how scores of various lengths in a paper blank extend downwardly in the sidewall of a deep dish disposable container fabricated in accordance with the present invention.
Figure 6B:
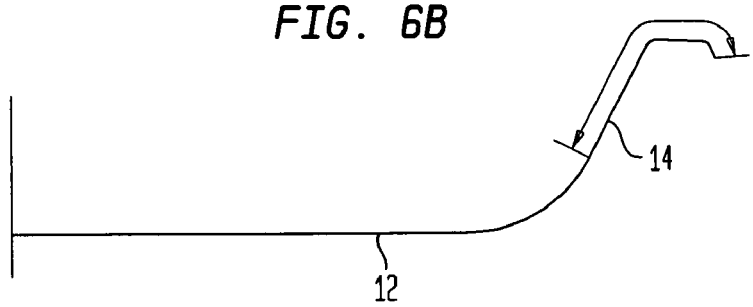
Figure 6C:
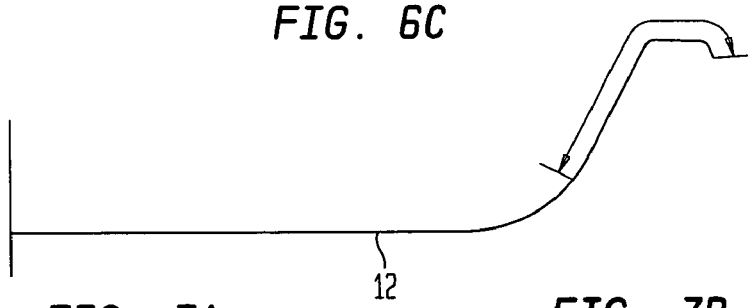

There are provided as FIGS. 6A–6C schematic diagrams of a deep dish container with a 1¼ inch height prepared from an 11.09 inch diameter flat paperboard blank. The radius of the product is only 4.794 inches as discussed above; however, it can be seen from FIG. 6A that the profile perimeter length is 5.547 inches. One typically scores the paperboard blank such that the scores extend from the outermost periphery of the product to a "starting point" on the sidewall below which the blank (and hence the product as well) is unscored. In general, it is desirable that the score extend from the product's outermost portion to a level substantially above (0.15 to 0.3 inches above typically) the substantially planar bottom portion 12 over a height which is at least about 50% of the height of the product, and preferably over a height which is at least about 75% of the height of the product. In FIG. 6B the score extends downwardly along sidewall 14 over a height which is 52% of the product height (i.e., (1.25–0.595)/1.25)×100%. Whereas, FIG. 6C illustrates a score height corresponding to a 1.844 inch score in the D4 blank which extends downwardly along sidewall 14 over a height which is about 82% of the height of the product; that is $$[(1.25-0.223)/1.25]\times 100\%$$

yet is still substantially above the substantially planar bottom of the container.

Figure 7A:
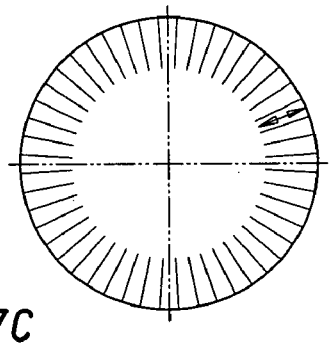
FIGS. 7A–7D are diagrams illustrating various score patterns in paperboard blanks used to fabricate deep dish disposable containers in accordance with the invention.
Figure 7B:
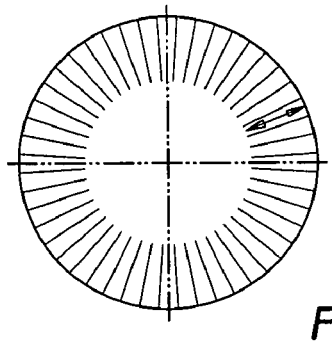
Figure 7C:
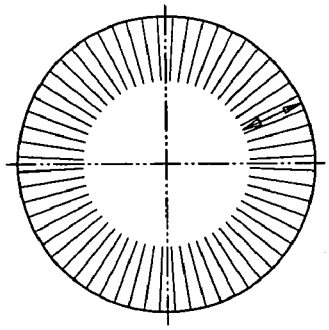
Figure 7D:
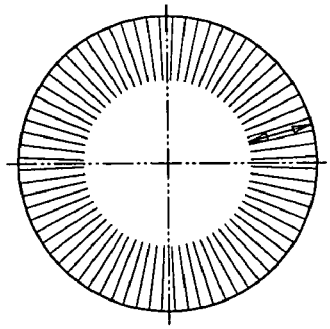

In FIGS. 7A–7D there are shown circular and planar paperboard blanks with various score patterns. The effect of the score pattern on paperboard takeup and excess paperboard per score calculations is seen in Tables 4 and 5 below as well as in FIGS. 8 through 11. FIG. 7A represents a score pattern of 48 radial scores of 1.422 inches in length; FIG. 7B is a score pattern of 48 radial scores of 1.844 inches in length; FIG. 7C is a score pattern of 60 radial scores having a length of 1.844 inches; and FIG. 7D represents a score pattern of 72 radial scores having a length of 1.844 inches.

Scoring of the paperboard stock is carried out in a press provided with aligned score rules and a counter plate having, for example, the patterns shown in FIGS. 7A–7D. The scoring rules commonly are made from hardened steel and the counter plates from chemically etched aluminum or steel or machined in phenolic resin laminate. Preferably, scoring results in deformation of the paperboard into a U-shaped geometry and with internal fiber delamination which, in turn, results in a U-shaped pleat as is appreciated by reference to FIGS. 8A–8C.

Figure 8A:
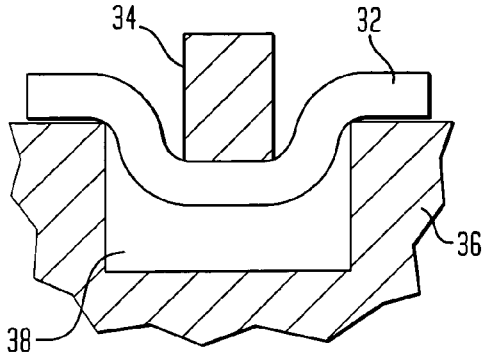
FIGS. 8A–8C are diagrams illustrating a preferred mode of paper scoring for scoring paperboard blanks.
Figure 8B:
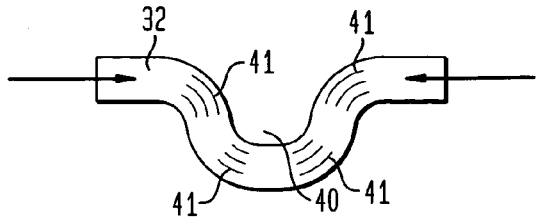
Figure 8C:
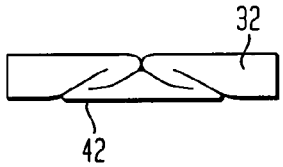

In FIG. 8A there is shown a portion of paperboard stock 32 positioned between a score rule 34 and a scoring counter 36 provided with a channel 38 as would be the case in a scoring press or scoring portion of a pressware forming press. The geometry is such that when the press proceeds reciprocally downwardly and scores blank 32, U-shaped score 40 results. Delamination of the paperboard is focused primarily in the sharp corner regions indicated at 41 in FIG. 8B. The same reciprocal scoring operation could be performed in a separate press operation to create blanks that are fed and formed subsequently. Alternatively, a rotary scoring and blanking operation may be utilized as is known in the art. When the product is formed in a heated matched die set, a U-shaped pleat 42 with a plurality of thicknesses of paperboard along the pleat in the product is formed such that pleats 30 generally have this configuration. The structure of pleat 42 is preferably a densified structure as shown schematically in FIG. 8C where the layers of paperboard are reformed into substantially integrated fibrous structures generally inseparable into their constituent layers and having a thickness generally equal to the circumferentially adjacent areas of the rim. As is shown in FIG. 8C, the pleats preferably include from 2 up to a maximum of 3 paperboard layers over the width of the pleat. The pleats 42 in the finished product extend generally over the entire length of the score which was present in the blank from which the product was made. Preferably the integrated fibrous structures extend over the entire length of the pleat, but may extend only over the pleat in the sidewall or flange of the article. In all cases it is preferable that the integrated fibrous structures form extend over at least a portion of the length of the pleat, more preferably over at least 50% of the length of the pleat and most preferably over at least 75% of the length of the pleat. Thus, for the products made from an 11.09 inch blank with a profile perimeter length of 5.547 and scores extending inwardly from the outside edge of the article over a profile distance of 1.844 inches, the integrated densified region preferably extends at least about 0.9 inches over a length corresponding to the score in the blank and preferably over 1.4 inches corresponding to the score position. Since the densified regions are formed by pleating at the scores, the location and spacing of the densified regions in the finished products corresponds to the scores in the blank from which the product was formed.

Figure 9:
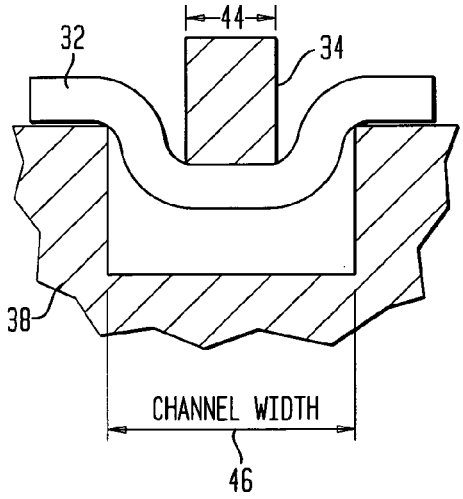
FIG. 9 is a schematic diagram illustrating preferred relative dimensions of a scoring operation showing a single rule, a single paperboard stock and one channel in a scoring press for fabricating scored paperboard blanks used to make the containers of the present invention.

Referring to FIG. 9, rule 34 typically has a width 44 of 0.028 inches, whereas scoring channel 38 has a width 46 equal to the score rule width 44 plus 2 paperboard thicknesses and a clearance which may be 0.005 inches or may be from about 0 to about 0.01 inches. In any event, it is preferred to achieve U-shaped symmetrical geometry and internal fiber delamination in the paperboard prior to cutting the blank into the desired shape.

The scores thus formed in the paperboard blank have a width corresponding to, preferably equal to, the width of the score rule that created them. As used herein, the score width is equated with the rule width for purposes of determining excess paperboard per score and percent excess paperboard per score as will be appreciated from considering Tables 4 and 5.

In Table 4, the total circumferential board take up is calculated for a nominal 9½ inch diameter deep dish container as in Table 3, that is, for a 9.588 inch diameter product having a height of 1¼ inches made from an 11.09 inch diameter paperboard blank of the general shape described in the second column of Table 1. The total circumferential board takeup at a given product radius is calculated as:

$$(\text{Corresponding Blank Radius}-\text{Product Radius})\times 2\pi$$

Figure 10:
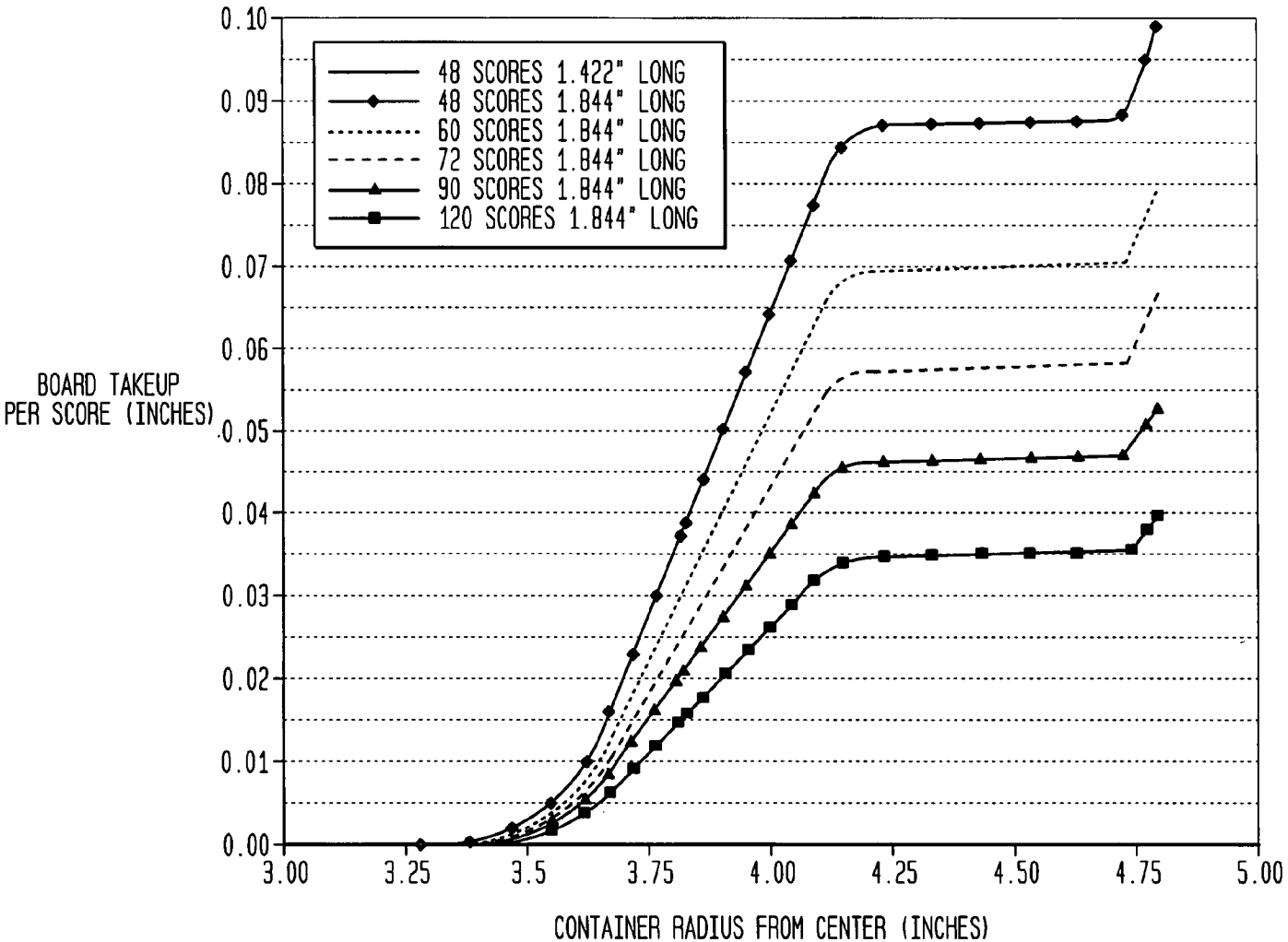
FIG. 10 is a plot of paperboard takeup per score (inches) versus container radius for a nominally 9½-inch diameter/1¼" height deep dish container made from paperboard blanks having different score patterns.

This takeup is then divided by the number of scores at that product radius in order to calculate the total circumferential board takeup per score. Thus for the products made from an 11.09 inch blank with various score patterns at a product radius of 4.001 inches, the corresponding blank radius is 4.499 inches, the total circumferential board takeup at this radius is $(4.499-4.001)\times 2\pi$ or 3.129 inches. For a 48 score pattern, the takeup per score is 3.129/48 or 0.065 inches; for a 60 score pattern, the takeup is 3.129/60 or 0.052 inches and so on. This data is also seen in FIG. 10 for the various score patterns. The 60 to 90 score patterns with a 2-point rule shown are preferred.

In Table 5, there is calculated the circumferential board takeup for the various blank patterns as in Table 4 for the same nominal 9½ inch products, from which the available score width (score or rule width times number of scores) is subtracted in order to determine the excess circumferential board width, which, in turn, is divided by the number of scores in order to calculate the excess paperboard per score. That is to say, for each product, at each radial increment, the total circumferential board takeup is calculated by taking the difference between the corresponding blank radius and product radius and multiplying by $2\pi$. The length takeup available is then calculated as the score width at that radius times the number of scores. The excess board per score is then calculated by subtracting the length takeup available from the total circumferential board takeup and dividing the difference by the number of scores. Thus at a product radius of 4.001 inches, the corresponding blank radius is 4.499 inches, the total circumferential board takeup is $(4.499-4.001)\times 2\pi$ or 3.129 inches. For a 2-point, 48 score pattern at this radius, the excess paperboard per score is then calculated as $[3.129-(0.028\times 48)]\div 48$ or 0.037 inches. Likewise, the excess paperboard per score at this radius for the 2-point, 60 score pattern is $[3.129-(0.028\times 60)]/60$ or 0.024 inches. The excess paperboard per score is expressed on a percentage (dimensionless) basis by simply dividing the excess paperboard per score in inches by the score width. Thus for the 2-point 60 score pattern having 0.024 inches excess board per score at a product radius of 4.001 inches as calculated above, the percentage excess paperboard per score at this radius is simply $(0.024''/0.028'')\times 100\%$ or about 85% excess paperboard per score. This data also appears in FIG. 11 wherein the preferred patterns of about 60 to about 90 scores exhibit an excess board per score of more than about 0.025 to about 0.04 inches per score about their outer flange portions. It should be appreciated from FIG. 11 that the shape of the curve plotted for the various products is a consequence of the container shape. That is to say, the excess paperboard per score sharply increases where the upwardly extending sidewall begins to rise upwardly (at a radius of about 3.6 inches in most cases shown) because the product radius is much smaller than the corresponding blank radius and is relatively constant; in other words the corresponding blank radius is increasing much more than the product radius in this region. At a radius of about 4.1 inches the excess paperboard per score remains relatively constant over a radial expanse of about 0.6 inches which corresponds to the relatively horizontal flange portion. That is to say, the excess paperboard per score is relatively constant about the flange since both the blank and the product are relatively planar. At about 4.75 inches of product radius, the excess paperboard per score again increases sharply since the downwardly extending lip again has a substantial vertical component.

TABLE 4

| Column #1 CORRESPONDING BLANK RADIUS FROM CENTER (IN) | Column #2 DEEP DISH RADIUS (IN) | Column #3 TOTAL CIRCUMFERENTIAL BOARD TAKEUP (IN) | Column #4 48 SCORE 2 PT RULE 1 422" LENGTH TOTAL BOARD PER SCORE (IN) | Column #5 48 SCORE LONG 2 PT RULE 1 844" LENGTH TOTAL BOARD PER SCORE (IN) | Column #6 60 SCORE LONG 2 PT RULE 1 844" LENGTH TOTAL BOARD PER SCORE (IN) |
|---|---|---|---|---|---|
| 2.750 | 2.750 | 0.000 | 0.000 | 0.000 | 0.000 |
| 2.799 | 2.799 | 0.000 | 0.000 | 0.000 | 0.000 |
| 2.899 | 2.899 | 0.000 | 0.000 | 0.000 | 0.000 |
| 2.999 | 2.999 | 0.000 | 0.000 | 0.000 | 0.000 |
| 3.099 | 3.099 | 0.000 | 0.000 | 0.000 | 0.000 |
| 3.199 | 3.199 | 0.000 | 0.000 | 0.000 | 0.000 |
| 3.299 | 3.298 | 0.006 | 0.000 | 0.000 | 0.000 |
| 3.399 | 3.394 | 0.031 | 0.001 | 0.001 | 0.001 |
| 3.499 | 3.483 | 0.101 | 0.002 | 0.002 | 0.002 |
| 3.599 | 3.562 | 0.232 | 0.005 | 0.005 | 0.004 |

TABLE 4-continued

| | | | | | |
|---|---|---|---|---|---|
| 3.699 | 3.627 | 0.452 | 0.009 | 0.009 | 0.008 |
| 3.699 | 3.627 | 0.452 | 0.009 | 0.009 | 0.008 |
| 3.799 | 3.678 | 0.760 | 0.016 | 0.016 | 0.013 |
| 3.899 | 3.724 | 1.100 | 0.023 | 0.023 | 0.018 |
| 3.999 | 3.770 | 1.439 | 0.030 | 0.030 | 0.024 |
| 4.099 | 3.817 | 1.772 | 0.037 | 0.037 | 0.030 |
| 4.125 | 3.829 | 1.860 | 0.039 | 0.039 | 0.031 |
| 4.125 | 3.829 | 1.860 | 0.039 | 0.039 | 0.031 |
| 4.199 | 3.863 | 2.111 | 0.044 | 0.044 | 0.035 |
| 4.299 | 3.909 | 2.450 | 0.051 | 0.051 | 0.041 |
| 4.399 | 3.955 | 2.790 | 0.058 | 0.058 | 0.046 |
| 4.499 | 4.001 | 3.129 | 0.065 | 0.065 | 0.052 |
| 4.599 | 4.047 | 3.468 | 0.072 | 0.072 | 0.058 |
| 4.699 | 4.093 | 3.808 | 0.079 | 0.079 | 0.063 |
| 4.799 | 4.150 | 4.078 | 0.085 | 0.085 | 0.068 |
| 4.899 | 4.235 | 4.172 | 0.087 | 0.087 | 0.070 |
| 4.999 | 4.334 | 4.178 | 0.087 | 0.087 | 0.070 |
| 5.099 | 4.433 | 4.185 | 0.087 | 0.087 | 0.070 |
| 5.199 | 4.533 | 4.185 | 0.087 | 0.087 | 0.070 |
| 5.299 | 4.633 | 4.185 | 0.087 | 0.087 | 0.070 |
| 5.399 | 4.728 | 4.216 | 0.088 | 0.088 | 0.070 |
| 5.499 | 4.776 | 4.543 | 0.095 | 0.095 | 0.076 |
| 5.547 | 4.794 | 4.731 | 0.099 | 0.099 | 0.079 |

| Column #1 CORRESPONDING BLANK RADIUS FROM CENTER (IN) | Column #2 DEEP DISH RADIUS | Column #3 TOTAL CIRCUMFERENTIAL BOARD TAKEUP (IN) | Column #7 72 SCORE LONG 2 PT RULE 1 844" LENGTH TOTAL BOARD PER SCORE (IN) | Column #8 90 SCORE LONG 2 PT RULE 1 844" LENGTH TOTAL BOARD PER SCORE (IN) | Column #9 120 SCORE LONG 2 PT RULE 1 844" LENGTH TOTAL BOARD PER SCORE (IN) |
|---|---|---|---|---|---|
| 2.750 | 2.750 | 0.000 | 0.000 | 0.000 | 0.000 |
| 2.799 | 2.799 | 0.000 | 0.000 | 0.000 | 0.000 |
| 2.899 | 2.899 | 0.000 | 0.000 | 0.000 | 0.000 |
| 2.999 | 2.999 | 0.000 | 0.000 | 0.000 | 0.000 |
| 3.099 | 3.099 | 0.000 | 0.000 | 0.000 | 0.000 |
| 3.199 | 3.199 | 0.000 | 0.000 | 0.000 | 0.000 |
| 3.299 | 3.298 | 0.006 | 0.000 | 0.000 | 0.000 |
| 3.399 | 3.394 | 0.031 | 0.000 | 0.000 | 0.000 |
| 3.499 | 3.483 | 0.101 | 0.001 | 0.001 | 0.001 |
| 3.599 | 3.562 | 0.232 | 0.003 | 0.003 | 0.002 |
| 3.699 | 3.627 | 0.452 | 0.006 | 0.005 | 0.004 |
| 3.699 | 3.627 | 0.452 | 0.006 | 0.005 | 0.004 |
| 3.799 | 3.678 | 0.760 | 0.011 | 0.008 | 0.006 |
| 3.899 | 3.724 | 1.100 | 0.015 | 0.012 | 0.009 |
| 3.999 | 3.770 | 1.439 | 0.020 | 0.016 | 0.012 |
| 4.099 | 3.817 | 1.772 | 0.025 | 0.020 | 0.015 |
| 4.125 | 3.829 | 1.860 | 0.026 | 0.021 | 0.015 |
| 4.125 | 3.829 | 1.860 | 0.026 | 0.021 | 0.015 |
| 4.199 | 3.863 | 2.111 | 0.029 | 0.023 | 0.018 |
| 4.299 | 3.909 | 2.450 | 0.034 | 0.027 | 0.020 |
| 4.399 | 3.955 | 2.790 | 0.039 | 0.031 | 0.023 |
| 4.499 | 4.001 | 3.129 | 0.043 | 0.035 | 0.026 |
| 4.599 | 4.047 | 3.468 | 0.048 | 0.039 | 0.029 |
| 4.699 | 4.093 | 3.808 | 0.053 | 0.042 | 0.032 |
| 4.799 | 4.150 | 4.078 | 0.057 | 0.045 | 0.034 |
| 4.899 | 4.235 | 4.172 | 0.058 | 0.046 | 0.035 |
| 4.999 | 4.334 | 4.178 | 0.058 | 0.046 | 0.035 |
| 5.099 | 4.433 | 4.185 | 0.058 | 0.046 | 0.035 |
| 5.199 | 4.533 | 4.185 | 0.058 | 0.046 | 0.035 |
| 5.299 | 4.633 | 4.185 | 0.058 | 0.046 | 0.035 |
| 5.399 | 4.728 | 4.216 | 0.059 | 0.047 | 0.035 |
| 5.499 | 4.776 | 4.543 | 0.063 | 0.050 | 0.038 |
| 5.547 | 4.794 | 4.731 | 0.066 | 0.053 | 0.039 |

Column Definitions & Calculations
Column #1 Corresponding Blank radius incremented throughout deep dish profile = RB
Column #2 Deep dish radius determined from AutoCad R14 = RP
Column #3 Total circumferential Board Takeup = C = (RB-RP) *2* PI where PI = 3 14159
Column #4 48 short score total board per score = C/48 or total circumferential board takeup/number of scores
Column #5 48 long score total board per score = C/48 or total circumferential board takeup/number of scores
Column #6 60 long score total board per score = C/60 or total circumferential board takeup/number of scores
Column #7 72 long score total board per score = C/72 or total circumferential board takeup/number of scores
Column #8 90 long total board per score = C/90 or total circumfernetial board takeup/number of scores
Column #9 120 long score score total board score = C/120 or total circumferential board takeup/number of scores

TABLE 5

Theoretical Paperboard Gathering During Forming.
1¼" Deep Dish Product. (10–250)

| Column #1 CORRESPONDING BLANK RADIUS FROM CENTER (IN) | Column #2 DEEP DISH RADIUS (IN) | Column #3 TOTAL CIRCUMFERENTIAL BOARD TAKEUP (IN) | Column #4 48 SCORE SHORT 2 PT. RULE 1.422" LENGTH TAKEUP AVAILABLE (IN) | Column #5 48 SCORE 2 PT. RULE 1.422" LENGTH EXCESS BOARD PER SCORE (IN) | Column #6 48 SCORE LONG 2 PT. RULE 1.844" LENGTH TAKEUP AVAILABLE (IN) |
|---|---|---|---|---|---|
| 2.750 | 2.750 | 0.000 | 0.000 | 0.000 | 0.000 |
| 2.799 | 2.799 | 0.000 | 0.000 | 0.000 | 0.000 |
| 2.899 | 2.899 | 0.000 | 0.000 | 0.000 | 0.000 |
| 2.999 | 2.999 | 0.000 | 0.000 | 0.000 | 0.000 |
| 3.099 | 3.099 | 0.000 | 0.000 | 0.000 | 0.000 |
| 3.199 | 3.199 | 0.000 | 0.000 | 0.000 | 0.000 |
| 3.299 | 3.298 | 0.006 | 0.000 | 0.000 | 0.000 |
| 3.399 | 3.394 | 0.031 | 0.000 | 0.001 | 0.000 |
| 3.499 | 3.483 | 0.101 | 0.000 | 0.002 | 0.000 |
| 3.599 | 3.562 | 0.232 | 0.000 | 0.005 | 0.000 |
| 3.699 | 3.627 | 0.452 | 0.000 | 0.009 | 0.000 |
| 3.699 | 3.627 | 0.452 | 0.000 | 0.009 | 1.344 |
| 3.799 | 3.678 | 0.760 | 0.000 | 0.016 | 1.344 |
| 3.899 | 3.724 | 1.100 | 0.000 | 0.023 | 1.344 |
| 3.999 | 3.770 | 1.439 | 0.000 | 0.030 | 1.344 |
| 4.099 | 3.817 | 1.772 | 0.000 | 0.037 | 1.344 |
| 4.125 | 3.829 | 1.860 | 0.000 | 0.039 | 1.344 |
| 4.125 | 3.829 | 1.860 | 1.344 | 0.011 | 1.344 |
| 4.199 | 3.863 | 2.111 | 1.344 | 0.016 | 1.344 |
| 4.299 | 3.909 | 2.450 | 1.344 | 0.023 | 1.344 |
| 4.399 | 3.955 | 2.790 | 1.344 | 0.030 | 1.344 |
| 4.499 | 4.001 | 3.129 | 1.344 | 0.037 | 1.344 |
| 4.599 | 4.047 | 3.468 | 1.344 | 0.044 | 1.344 |
| 4.699 | 4.093 | 3.808 | 1.344 | 0.051 | 1.344 |
| 4.799 | 4.150 | 4.078 | 1.344 | 0.057 | 1.344 |
| 4.899 | 4.235 | 4.172 | 1.344 | 0.059 | 1.344 |
| 4.999 | 4.334 | 4.178 | 1.344 | 0.059 | 1.344 |
| 5.099 | 4.433 | 4.185 | 1.344 | 0.059 | 1.344 |
| 5.199 | 4.533 | 4.185 | 1.344 | 0.059 | 1.344 |
| 5.299 | 4.633 | 4.185 | 1.344 | 0.059 | 1.344 |
| 5.399 | 4.728 | 4.216 | 1.344 | 0.060 | 1.344 |
| 5.499 | 4.776 | 4.543 | 1.344 | 0.067 | 1.344 |
| 5.547 | 4.794 | 4.731 | 1.344 | 0.071 | 1.344 |

| Column #1 CORRESPONDING BLANK RADIUS FROM CENTER (IN) | Column #2 DEEP DISH RADIUS (IN) | Column #3 TOTAL CIRCUMFERENTIAL BOARD TAKEUP (IN) | Column #7 48 SCORE LONG 2 PT. RULE 1.844" LENGTH TAKEUP AVAILABLE (IN) | Column #8 60 SCORE LONG 2 PT. RULE 1.844 LENGTH EXCESS BOARD PER SCORE (IN) | Column #9 60 SCORE LONG 2 PT. RULE 1.844" LENGTH EXCESS BOARD PER SCORE (IN) |
|---|---|---|---|---|---|
| 2.750 | 2.750 | 0.000 | 0.000 | 0.000 | 0.000 |
| 2.799 | 2.799 | 0.000 | 0.000 | 0.000 | 0.000 |
| 2.899 | 2.899 | 0.000 | 0.000 | 0.000 | 0.000 |
| 2.999 | 2.999 | 0.000 | 0.000 | 0.000 | 0.000 |
| 3.099 | 3.099 | 0.000 | 0.000 | 0.000 | 0.000 |
| 3.199 | 3.199 | 0.000 | 0.000 | 0.000 | 0.000 |
| 3.299 | 3.298 | 0.006 | 0.000 | 0.000 | 0.000 |
| 3.399 | 3.394 | 0.031 | 0.001 | 0.000 | 0.001 |
| 3.499 | 3.483 | 0.101 | 0.002 | 0.000 | 0.002 |
| 3.599 | 3.562 | 0.232 | 0.005 | 0.000 | 0.004 |
| 3.699 | 3.627 | 0.452 | 0.009 | 0.000 | 0.008 |
| 3.699 | 3.627 | 0.452 | −0.019 | 1.680 | −0.020 |
| 3.799 | 3.678 | 0.760 | −0.012 | 1.680 | −0.015 |
| 3.899 | 3.724 | 1.100 | −0.005 | 1.680 | −0.010 |
| 3.999 | 3.770 | 1.439 | 0.002 | 1.680 | −0.004 |
| 4.099 | 3.817 | 1.772 | 0.009 | 1.680 | 0.002 |
| 4.125 | 3.829 | 1.860 | 0.011 | 1.680 | 0.003 |
| 4.125 | 3.829 | 1.860 | 0.011 | 1.680 | 0.003 |
| 4.199 | 3.863 | 2.111 | 0.016 | 1.680 | 0.007 |
| 4.299 | 3.909 | 2.450 | 0.023 | 1.680 | 0.013 |
| 4.399 | 3.955 | 2.790 | 0.030 | 1.680 | 0.018 |
| 4.499 | 4.001 | 3.129 | 0.037 | 1.680 | 0.024 |
| 4.599 | 4.047 | 3.468 | 0.044 | 1.680 | 0.030 |
| 4.699 | 4.093 | 4.808 | 0.051 | 1.680 | 0.035 |
| 4.799 | 4.150 | 4.078 | 0.057 | 1.680 | 0.040 |
| 4.899 | 4.235 | 4.172 | 0.059 | 1.680 | 0.042 |
| 4.999 | 4.334 | 4.178 | 0.059 | 1.680 | 0.042 |
| 5.099 | 4.433 | 4.185 | 0.059 | 1.680 | 0.042 |

TABLE 5-continued

Theoretical Paperboard Gathering During Forming.
1¼" Deep Dish Product. (10–250)

| | | | | | |
|---|---|---|---|---|---|
| 5.199 | 4.533 | 4.185 | 0.059 | 1.680 | 0.042 |
| 5.299 | 4.633 | 4.185 | 0.059 | 1.680 | 0.042 |
| 5.399 | 4.728 | 4.216 | 0.060 | 1.680 | 0.042 |
| 5.499 | 4.776 | 4.543 | 0.067 | 1.680 | 0.048 |
| 5.547 | 4.794 | 4.731 | 0.071 | 1.680 | 0.051 |

| Column #1 CORRESPONDING BLANK RADIUS FROM CENTER (IN) | Column #2 DEEP DISH RADIUS (IN) | Column #3 TOTAL CIRCUMFERENTIAL BOARD TAKEUP (IN) | Column #10 72 SCORE LONG 2 PT RULE 1 844" LENGTH TAKEUP AVAILABLE (IN) | Column #11 72 SCORE LONG 2 PT RULE 1 844" LENGTH EXCESS BOARD PER SCORE (IN) | Column #12 90 SCORE LONG 2 PT RULE 1 844" LENGTH TAKEUP AVAILABLE (IN) |
|---|---|---|---|---|---|
| 2.750 | 2.750 | 0.000 | 0.000 | 0.000 | 0.000 |
| 2.799 | 2.799 | 0.000 | 0.000 | 0.000 | 0.000 |
| 2.899 | 2.899 | 0.000 | 0.000 | 0.000 | 0.000 |
| 2.999 | 2.999 | 0.000 | 0.000 | 0.000 | 0.000 |
| 3.099 | 3.099 | 0.000 | 0.000 | 0.000 | 0.000 |
| 3.199 | 3.199 | 0.000 | 0.000 | 0.000 | 0.000 |
| 3.299 | 3.298 | 0.006 | 0.000 | 0.000 | 0.000 |
| 3.399 | 3.394 | 0.031 | 0.000 | 0.000 | 0.000 |
| 3.499 | 3.483 | 0.101 | 0.000 | 0.001 | 0.000 |
| 3.599 | 3.562 | 0.232 | 0.000 | 0.003 | 0.000 |
| 3.699 | 3.627 | 0.452 | 0.000 | 0.006 | 0.000 |
| 3.699 | 3.627 | 0.452 | 2.016 | −0.022 | 2.520 |
| 3.799 | 3.678 | 0.760 | 2.016 | −0.017 | 2.520 |
| 3.899 | 3.724 | 1.100 | 2.016 | −0.013 | 2.520 |
| 3.999 | 3.770 | 1.439 | 2.016 | −0.008 | 2.520 |
| 4.099 | 3.817 | 1.772 | 2.016 | −0.003 | 2.520 |
| 4.125 | 3.829 | 1.860 | 2.016 | −0.002 | 2.520 |
| 4.125 | 3.829 | 1.860 | 2.016 | −0.002 | 2.520 |
| 4.199 | 3.863 | 2.111 | 2.016 | 0.001 | 2.520 |
| 4.299 | 3.909 | 2.450 | 2.016 | 0.006 | 2.520 |
| 4.399 | 3.955 | 2.790 | 2.016 | 0.011 | 2.520 |
| 4.499 | 4.001 | 3.129 | 2.016 | 0.015 | 2.520 |
| 4.599 | 4.047 | 3.468 | 2.016 | 0.020 | 2.520 |
| 4.699 | 4.093 | 3.808 | 2.016 | 0.025 | 2.520 |
| 4.799 | 4.150 | 4.078 | 2.016 | 0.029 | 2.520 |
| 4.899 | 4.235 | 4.172 | 2.016 | 0.030 | 2.520 |
| 4.999 | 4.334 | 4.178 | 2.016 | 0.030 | 2.520 |
| 5.099 | 4.433 | 4.185 | 2.016 | 0.030 | 2.520 |
| 5.199 | 4.533 | 4.185 | 2.016 | 0.030 | 2.520 |
| 5.299 | 4.633 | 4.185 | 2.016 | 0.030 | 2.520 |
| 5.399 | 4.728 | 4.216 | 2.016 | 0.031 | 2.520 |
| 5.499 | 4.776 | 4.543 | 2.016 | 0.035 | 2.520 |
| 5.547 | 4.794 | 4.731 | 2.016 | 0.038 | 2.520 |

| Column #1 BLANK RADIUS FROM CENTER (IN) | Column #2 DEEP DISH RADIUS (IN) | Column #3 TOTAL CIRCUMFERENTIAL BOARD TAKEUP (IN) | Column #13 90 SCORE LONG 2 PT RULE 1 844" LENGTH EXCESS BOARD PER SCORE (IN) | Column #14 120 SCORE LONG 2 PT RULE 1 844" LENGTH TAKEUP AVAILABLE (IN) | Column #15 120 SCORE LONG 2 PT RULE 1 844" LENGTH EXCESS BOARD PER SCORE (IN) |
|---|---|---|---|---|---|
| 2.750 | 2.750 | 0.000 | 0.000 | 0.000 | 0.000 |
| 2.799 | 2.799 | 0.000 | 0.000 | 0.000 | 0.000 |
| 2.899 | 2.899 | 0.000 | 0.000 | 0.000 | 0.000 |
| 2.999 | 2.999 | 0.000 | 0.000 | 0.000 | 0.000 |
| 3.099 | 3.099 | 0.000 | 0.000 | 0.000 | 0.000 |
| 3.199 | 3.199 | 0.000 | 0.000 | 0.000 | 0.000 |
| 3.299 | 3.298 | 0.006 | 0.000 | 0.000 | 0.000 |
| 3.399 | 3.394 | 0.031 | 0.000 | 0.000 | 0.000 |
| 3.499 | 3.483 | 0.101 | 0.001 | 0.000 | 0.001 |
| 3.599 | 3.562 | 0.232 | 0.003 | 0.000 | 0.002 |
| 3.699 | 3.627 | 0.452 | 0.005 | 0.000 | 0.004 |
| 3.699 | 3.627 | 0.452 | −0.023 | 3.360 | −0.024 |
| 3.799 | 3.678 | 0.760 | −0.020 | 3.360 | −0.022 |
| 3.899 | 3.724 | 1.100 | −0.016 | 3.360 | −0.019 |
| 3.999 | 3.770 | 1.439 | −0.012 | 3.360 | −0.016 |
| 4.099 | 3.817 | 1.772 | −0.008 | 3.360 | −0.013 |
| 4.125 | 3.829 | 1.860 | −0.007 | 3.360 | −0.013 |
| 4.125 | 3.829 | 1.860 | −0.007 | 3.360 | −0.013 |
| 4.199 | 3.863 | 2.111 | −0.005 | 3.360 | −0.010 |
| 4.299 | 3.909 | 2.450 | −0.001 | 3.360 | −0.008 |
| 4.399 | 3.955 | 2.790 | 0.003 | 3.360 | −0.005 |

TABLE 5-continued

| Theoretical Paperboard Gathering During Forming. 1¼" Deep Dish Product. (10–250) | | | | | |
|---|---|---|---|---|---|
| 4.499 | 4.001 | 3.129 | 0.007 | 3.360 | −0.002 |
| 4.599 | 4.047 | 3.468 | 0.011 | 3.360 | 0.001 |
| 4.699 | 4.093 | 3.808 | 0.014 | 3.360 | 0.004 |
| 4.799 | 4.150 | 4.078 | 0.017 | 3.360 | 0.006 |
| 4.899 | 4.235 | 4.172 | 0.018 | 3.360 | 0.007 |
| 4.999 | 4.334 | 4.178 | 0.018 | 3.360 | 0.007 |
| 5.099 | 4.433 | 4.185 | 0.018 | 3.360 | 0.007 |
| 5.199 | 4.533 | 4.185 | 0.018 | 3.360 | 0.007 |
| 5.299 | 4.633 | 4.185 | 0.018 | 3.360 | 0.007 |
| 5.399 | 4.728 | 4.216 | 0.019 | 3.360 | 0.007 |
| 5.499 | 4.776 | 4.543 | 0.022 | 3.360 | 0.010 |
| 5.547 | 4.794 | 4.731 | 0.025 | 3.360 | 0.011 |

Column Definitions & Calculations
Column #1: Corresponding Blank radius incremented throughout deep dish profile = RB
Column #2: Deep dish radius determined from AutoCad R14 = RP
Column #3: Total Circumferential Board Takeup = C = (RB-RP) *2* PI where PI = 3.14159
Column #4: 48 short score takeup available = 2 pt or .028" × 48 scores = 1.344" = S4 starting at blank & plate radii where score starts.
Column #5: 48 short score excess board per score = (C-S4)/48 or (Circumferential Takeup-Takeup Available) / Number of Scores.
Column #6: 48 long score takeup available = 2pt. Or 0 028" × 48 scores = 1.344" = S6 starting at blank & plate radii where score starts.
Column #7: 48 short long excess board per score = (C-S6)/48 or (Circumferential Takeup-Takeup Available) / Number of Scores.
Column #8: 60 long score takeup available = 2pt or 0.028" × 60 scores = 1 688" = S8 starting at blank & plate radii where score starts.
Column #9: 60 long excess board per score = (C-S8)/60 or (Circumferential Takeup-Takeup Available) / Number of Scores.
Column #10: 72 long score takeup available = 2pt or .028" × 72 scores = 2.016" = s10 starting a blank & plate radii where score starts
Column #11: 72 long excess board per score = (C-S10)/72 or (Circumferential Takeup-Takeup Available) / Number of Scores
Column #12: 90 long score takeup available = 2pt Or 028" × 90 scores = 2.520" = S12 starting at blank&plate radii where score starts
Column #13: 90 long excess board per score = (C-S12)/90 or (Circumferential Takeup-Takeup Available) / Number of Scores
Column #14: 120 long score takeup available = 2pt or 0 028" × 120 scores = 3 360" = S14 starting at blank& plate radii where score starts
Column #15: 120 long excess board per score = (C-S14)/120 or (Circumferential Takeup-Takeup Available) / number of Scores In Table 6, there is compared the calculated excess paperboard per score at the center of the product flange for nominal 9½ inch diameter, 1¼ inch height deep dish containers of the present invention.

TABLE 6

| Pressware Product Scoring/Paperboard Takeup: | | | | | | | | | | |
|---|---|---|---|---|---|---|---|---|---|---|
| | | | | | | | Location of Calculations: Center of Product Flange | | | |
| Die Set | Blank Diameter (inches) | Theoretical** Product Diameter (inches) | Scoring Rule Pt. (1 pt = .014") | # of Rules (#) | Length of Rules (inches) | Total Score Rule Length (inches) | Total Board Takeup (inches) | Percent Board Takeup (%) | Board per score (inches) | "Excess" Board* per score (inches) |
| 1¼" Deep Dish (Pattern #1) | 11.094 | 9.588 | 2 | 60 | 1.84 | 110.64 | 4.19 | 12.9 | 0.07 | 0.041 |
| 1¼" Deep Dish (Pattern #2) | 11.094 | 9.588 | 2 | 72 | 1.84 | 132.48 | 4.19 | 12.9 | 0.058 | 0.030 |
| 1¼" Deep Dish (Pattern #3) | 11.094 | 9.588 | 2 | 48 | 1.84 | 88.32 | 4.19 | 12.9 | 0.087 | 0.059 |
| 1¼" Deep Dish (Pattern #4) | 11.094 | 9.588 | 2 | 90 | 1.84 | 165.60 | 4.19 | 12.9 | 0.047 | 0.019 |
| 1¼" Deep Dish (Pattern #5) | 11.094 | 9.588 | 2 | 120 | 1.84 | 220.80 | 4.19 | 12.9 | 0.035 | 0.007 |

Figure 11:
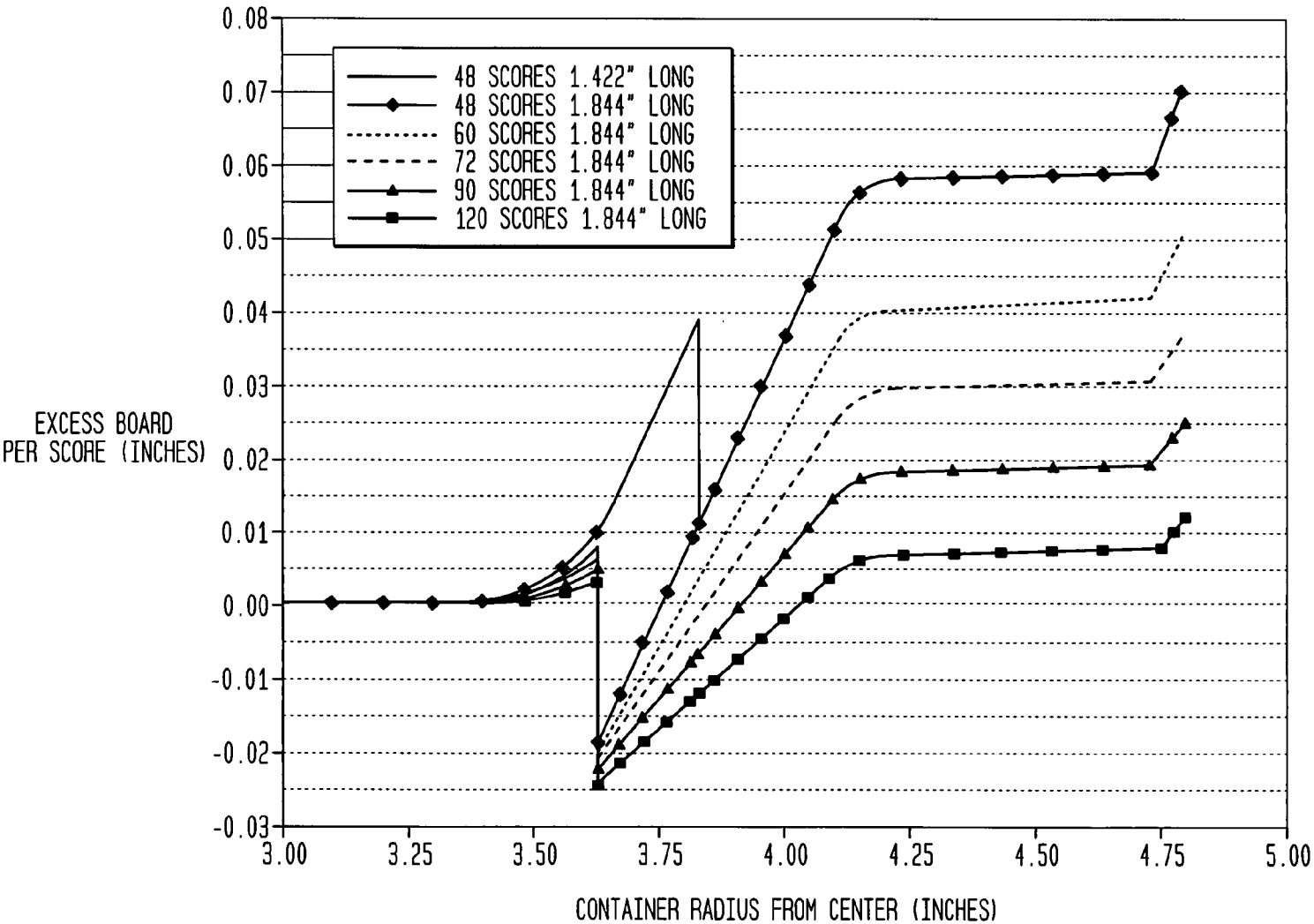
FIG. 11 is a plot of excess paperboard per score (inches) versus container radius for a nominally 9½ inch diameter/1¼" height deep dish container made from paperboard blanks having different score patterns.

*(Total Board Takeup - #Rules*Scoring Rule Point *0.014 [inches])/# Rules
assumes negligible stretch The data of Table 4 is shown in FIG. 10 which is a plot of Board Takeup per score versus container radius, whereas FIG. 11 is a plot of Excess Paperboard per score versus container radius for the deep dish disposable containers of the invention formed from a circular paperboard blank as is calculated in Table 5. As noted above, the excess paperboard per score may also be expressed as a percentage by dividing the excess paperboard per score (inches), by the score or rule width, in the above cases by 0.028 inches. Moreover, the shape of plots of FIGS. 10 and 11** are characteristic of the container shape.

EXAMPLES

Particularly preferred embodiments of the invention include deep-dish containers of a nominal 9½ inch diameter having a 1¼ inch height made from paperboard blanks having from about 60 to about 90 radial scores and most preferably about 75 radial scores. Advantages are seen as to rigidity and appearance. In particular, rigidity was measured by the SSI and an SSI/Instron technique as discussed further below. Further, samples made from paperboard blanks with different score patterns were examined visually for uniformity, which is an important attribute contributing to consumer perception of the product. Visual observation of uniformity correlated well with standard deviation in rigidity tests.

SSI rigidity was generally measured with the Single Service Institute Plate Rigidity Tester of the type originally available through Single Service Institute, 1025 Connecticut Ave., N.W., Washington, D.C. The SSI Rigidity test apparatus has been manufactured and sold through Sherwood Tool, Inc. Kensington, Conn. This test is designed to measure the rigidity (i.e., resistance to buckling and bending) of paper and plastic plates, bowls, dishes, and trays by measuring the force required to deflect the rim of these products a distance of 0.5 inch while the product is supported at its geometric center. Specifically, the plate specimen is restrained by an adjustable bar on one side and is center fulcrum supported. The rim or flange side opposite to the restrained side is subjected to 0.5 inch deflection by means of a motorized cam assembly equipped with a load cell, and the force (grams) is recorded. The test simulates in many respects the performance of a container as it is held in the hand of a consumer, supporting the weight of the container's contents. SSI rigidity is expressed as grams per 0.5 inch deflection. A higher SSI value is desirable since this indicates a more rigid product. All measurements were done at standard TAPPI conditions for paperboard testing, 72° F. and 50% relative humidity. Geometric mean averages for the machine direction (MD) and cross machine direction (CD) are reported herein.

The particular apparatus employed was a Model No. ML-4431-2 SSI rigidity tester as modified by Georgia Pacific Corporation, National Quality Assurance Lab, Lehigh Valley Plant, Easton, Pa. 18040 using a Chattillon gauge available from Chattillon, Force Measurements Division, P,.O. Box 35668, Greensboro, NC 27425-5668. Using this apparatus, the rigidity of a series of nominally 9½ diameter, 1¼ inch height deep dish containers having generally the dimensions of Column 2 of Table 1 above was evaluated. Results appear in Table 7 for deep dish containers made from paperboard blanks with different score patterns.

TABLE 7

SSI Rigidity for 9½" Diameter, 1¼" Height Deep Dish Containers

| Examples | Paperboard Blank | Plate Rigidity MD (kg) | Plate Rigidity CD (kg) | Plate Rigidity GM (kg) | Standard Deviation (GM, 3 samples) |
|---|---|---|---|---|---|
| 1 | 48 scores 1.422" long | 0.581 | 0.589 | 0.585 | 0.019 |
| 2 | 48 scores 1.844" long | 0.596 | 0.603 | 0.599 | 0.010 |
| 3 | 60 scores 1.844" long | 0.578 | 0.587 | 0.582 | 0.005 |
| 4 | 72 scores 1.844" long | 0.618 | 0.645 | 0.631 | 0.012 |
| 5 | 90 scores 1.844" long | 0.607 | 0.609 | 0.608 | 0.007 |
| 6 | 120 scores 1.844" long | 0.562 | 0.570 | 0.566 | 0.029 |

As will be appreciated from Table 7, deep dish containers made from blanks having from about 60 to about 90 scores generally exhibited higher rigidity and lower standard deviations in those rigidity measurements. The container made from a blank having 120 scores showed considerable flange distortion, suggesting the outer portions lacked even minimum stiffness requirements for compatibility with the manufacturing process, discussed further below.

In order to further assess performance of the deep dish containers of the invention a series of nominally 9½" diameter, 1¼" height deep dish containers like those of Examples 1–6 of Table 7 were evaluated using an apparatus similar to the SSI rigidity tester described above in connection with an Instron® tester to obtain continuous load versus deflection curves as opposed to the SSI rigidity test described above which only provides a load reading at one deflection, typically at a 0.5 inch deflection. Here again, all measurements were done at standard TAPPI conditions for paperboard testing, 72° F. and 50% relative humidity and geometric mean (GM) averages for the machine direction (MD) and cross machine direction (CD). Different containers were used for the various MD and CD tests so that the larger deflections did not influence the measurements. That is, a given container was tested for CD characteristics and another container was tested for MD characteristics. As in the SSI rigidity test, the containers were restrained in a mounting apparatus about 1 edge thereof and fulcrumed about their geometric centers while a probe advanced and deflected the container on its edge opposite the edge restrained in the mounting apparatus. The force required to deflect the flange of the container a given distance was recorded. GM load at various deflection increments appears below in Table 8.

TABLE 8

| Instron Rigidity | | | | | | |
|---|---|---|---|---|---|---|
| Example | 7 | 8 | 9 | 10 | 11 | 12 |
| # Scores in Paperboard Blank | 48 | 48 | 60 | 72 | 90 | 120 |
| Score Length | 1.422" | 1.844" | 1.844" | 1.844" | 1.844" | 1.844" |
| Deflection (Inches) | Load GM (grams) | Load GM (grams) | Load GM (grams) | Load GM (grams) | Load GM (grams) | Load GM (grams) |
| 0 | 0 | 0 | 0 | 0 | 0 | 0 |
| 0.1 | 142 | 126 | 123 | 163 | 138 | 105 |
| 0.2 | 295 | 265 | 251 | 326 | 289 | 229 |
| 0.3 | 429 | 404 | 381 | 456 | 423 | 341 |
| 0.4 | 527 | 517 | 488 | 541 | 517 | 428 |
| 0.5 | 596 | 597 | 569 | 597 | 580 | 496 |
| 0.6 | 640 | 651 | 625 | 630 | 621 | 545 |
| 0.7 | 666 | 685 | 661 | 652 | 647 | 582 |
| 0.8 | 670 | 706 | 684 | 664 | 663 | 604 |
| 0.9 | 679 | 714 | 696 | 668 | 668 | 621 |
| 1 | 670 | 722 | 701 | 657 | 662 | 624 |

Figure 12:
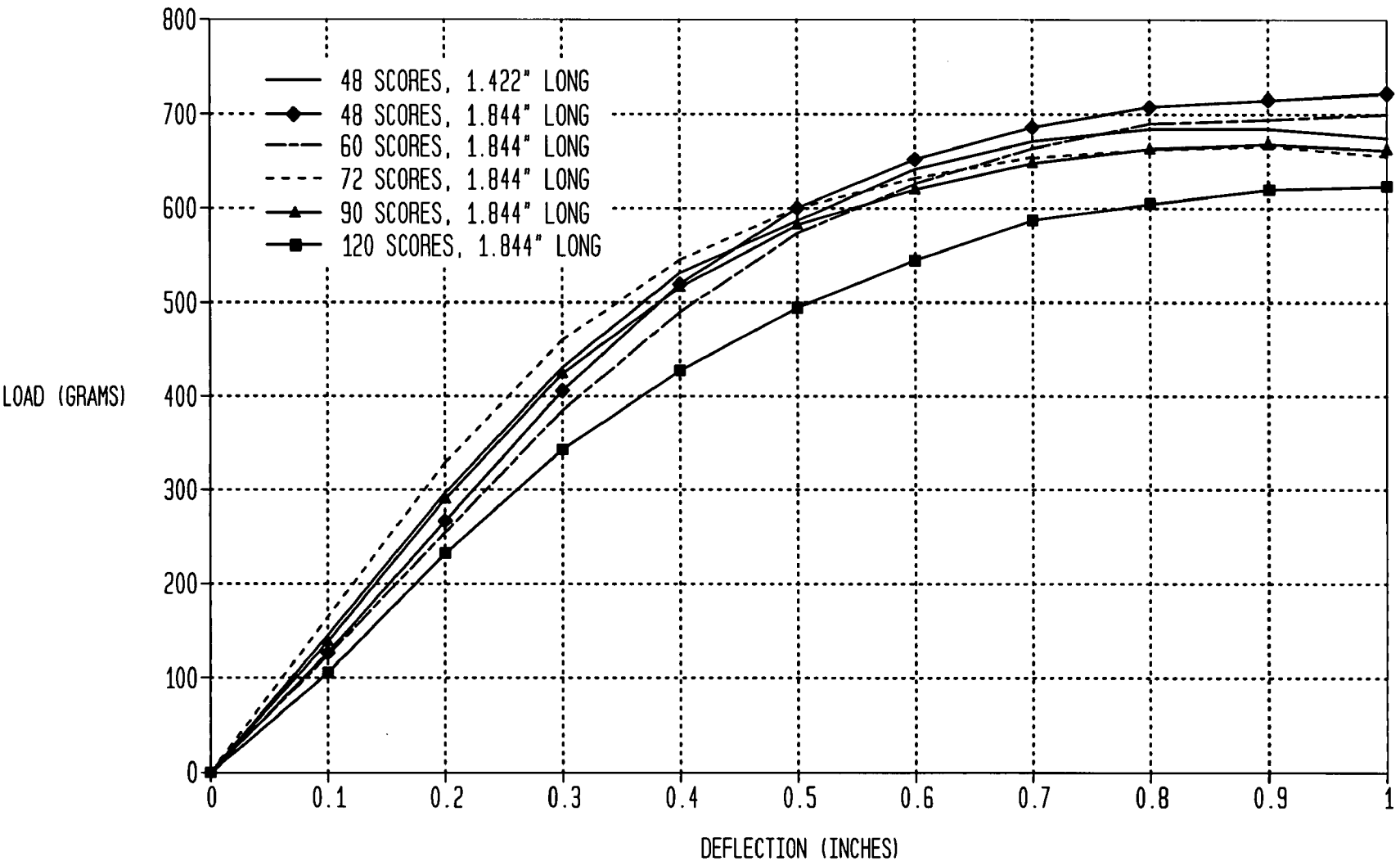
FIG. 12 is a plot of load on the rim vs. deflection for nominally 9½" diameter/1¼" height deep dish containers made from paperboard blanks having different score patterns.

The data in Table 8 appears in FIG. 12, which shows that the container made from a paperboard blank with 72 radial scores generally exhibits the most stiffness at low deflections, particularly at deflections of ½" or less. This region is believed the most significant for disposable food container products, since higher deflections, in practical terms, are less likely to occur with typical food loading (454 grams=1 lb. of food).

Figure 13A:
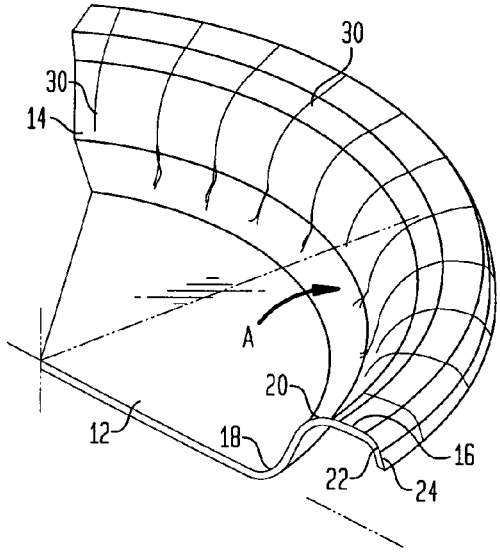
FIG. 13A is a schematic representation of a portion of a nominally 9½" diameter/1¼" height deep dish container made from a paperboard blank with a score pattern including 48 scores of a length 1.422 inches long illustrating variation in the pleat pattern.

In FIG. 13A there is shown schematically a portion of a nominal 9½" diameter, 1¼" height made from a paperboard blank with 48 1.422" scores. As can be seen at A, there tends to be non-uniformities particularly in the region between the lower portion of the sidewall and the bottom of the container where material is gathered somewhat randomly. Besides being unsightly, the non-uniform structure of the container leads to non-uniform properties between containers, as is reflected in the standard deviations in plate rigidity reported above.

Figure 13B:
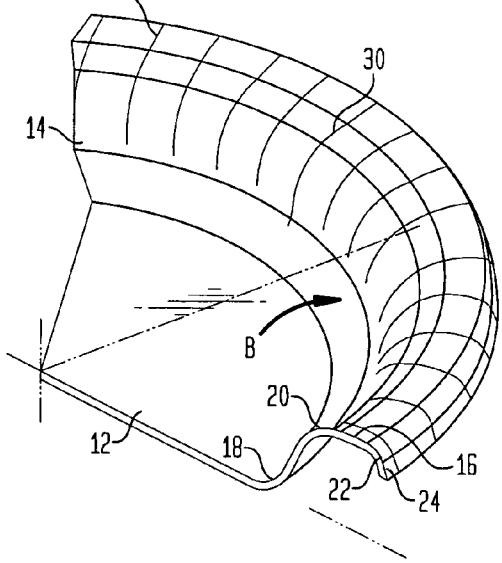
FIG. 13B is a schematic representation of a portion of a nominally 9½" diameter/1¼" height deep dish container made from a paperboard blank with a score pattern including 72 scores having a length of 1.844 inches illustrating uniformity in the pleat pattern.

FIG. 13B shows schematically a portion of a container similar to the one in FIG. 13A, except that the container was made from a paperboard blank with 72 1.844" radial scores. As shown at B, the pleats are relatively uniform. Product uniformity is reflected in the standard deviation in rigidity reported above for this geometry. That is, deep dish containers made from blanks with having from about 60 to about 90 scores generally exhibited lower standard deviations in the rigidity measurements.

Figure 13C:
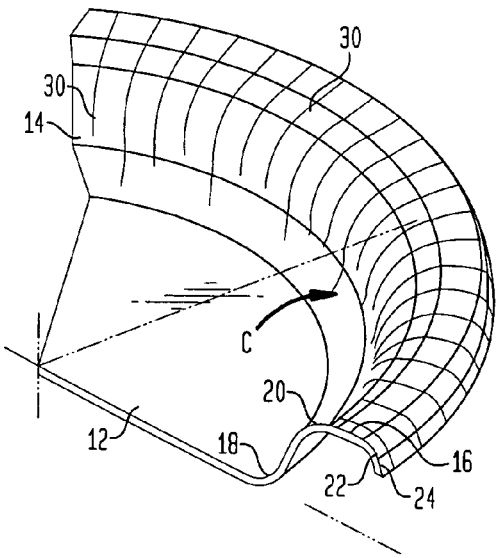
FIG. 13C is a schematic representation of a portion of a nominally 9½" diameter/1¼" height deep dish container made from a paperboard blank with a score pattern including 120 scores of a length of 1.844 inches again illustrating variation in the pleat pattern.

FIG. 13C is a schematic representation of a portion of a container similar to the one shown in FIG. 13B, except the container was made from a paperboard blank with 120 1.844" scores. Here, non-uniformities depicted at C include "unfilled" scores and somewhat random pleating. Considerable flange distortion was also observed, believed to have been caused by the ejection ring from the mold. Apparently, the brims were not robust enough to resist damage in the manufacturing process. Here again, the standard deviation was relatively high, indicative of non-uniform product.

The product of the invention is most preferably formed with a heated matched pressware die set utilizing inertial rotating pin blank stops as described in co-pending application U.S. Ser. No. 09/653,577, filed Aug. 31, 2000. For paperboard plate stock of conventional thicknesses in the range of from about 0.010 to about 0.040 inches. The springs upon which the lower die half is mounted are typically constructed such that the full stroke of the upper die results in a force applied between the dies of from about 6000 to 8000 pounds. The paperboard which is formed into the blanks is conventionally produced by a wet laid paper making process and is typically available in the form of a continuous web on a roll. The paperboard stock is preferred to have a basis weight in the range of from about 100 pounds to about 400 pounds per 3000 square foot ream and a thickness or caliper in the range of from about 0.010 to about 0.040 inches as noted above. Lower basis weight paperboard is preferred for ease of forming and to save on feedstock costs. Paperboard stock utilized for forming paper plates is typically formed from bleached pulp furnish, and is usually double clay coated on one side. Such paperboard stock commonly has a moisture (water content) varying from about 4.0 to about 8.0 percent by weight.

The effect of the compressive forces at the rim is greatest when the proper moisture conditions are maintained within the paperboard: at least 8% and less than 12% water by weight, and preferably 9.0 to 10.5%. Paperboard having moisture in this range has sufficient moisture to deform under pressure, but not such excessive moisture that water vapor interferes with the forming operation or that the paperboard is too weak to withstand the high compressive forces applied. To achieve the desired moisture levels within the paperboard stock as it comes off the roll, the paperboard is treated by spraying or rolling on a moistening solution, primarily water, although other components such as lubricants may be added. The moisture content may be monitored with a hand held capacitive type moisture meter to verify that the desired moisture conditions are being maintained. It is preferred that the plate stock not be formed for at least six hours after moistening to allow the moisture within the paperboard to reach equilibrium.

Because of the intended end use of the products, the paperboard stock is typically coated on one side with a liquid proof layer or layers comprising a press-applied, water-based coating applied over the inorganic pigment typically applied to the board during manufacturing. In addition, for esthetic reasons, the paperboard stock is often initially printed before being coated. As an example of typical coating material, a first layer of latex coating may be applied over the printed paperboard with a second layer of acrylic coating applied over the first layer. These coatings may be applied either using the conventional printing press used to apply the decorative printing or may be applied using some other form of a conventional press coater. Preferred coatings utilized in connection with the invention may include 2 pigment (clay) containing layers, with a binder, of 3 lbs/3000 $ft^2$ ream or so followed by 2 acrylic layers of about 0.5–1 lbs/3000 $ft^2$ ream. The layers are applied by press coating methods, i.e., gravure, coil coating, flexographic methods and so forth as opposed to extrusion or film laminating methods which are expensive and may require off-line processing as well as large amounts of coating material. An extruded film, for example, may require 25 lbs/3000 $ft^2$ ream. Suitable coatings are described in U.S. Pat. No. 5,876,815 to Sandstrom et al., the disclosure of which is incorporated herein by reference. The layer comprising a latex may contain any suitable latex known to the art. By way of example, suitable latexes include styrene-acrylic copolymer, acyrlonitrile styrene-acrylic copolymer, polyvinyl alcohol polymer, acrylic acid polymer, ethylene vinyl alcohol copolymer, ethylene-vinyl chloride copolymer, ethylene vinyl acetate copolymer, vinyl acetateacrylic copolymer, styrene-butadiene copolymer and acetateethylene copolymer. Preferably, the layer comprising a latex contains styrene-acrylic copolymer, styrene-butadiene copolymer, or vinyl acetate-acrylic copolymer. More preferably, the layer comprising a latex contains vinyl acetate ethylene copolymer. A commercially available vinyl acetate ethylene copolymer is "AIRFLEX® 100 HS" latex. ("AIRFLEX® 100 HS" is a registered trademark of Air Products and Chemicals, Inc.) Preferably, the layer comprising a latex contains a latex that is pigmented. Pigmenting the latex increases the coat weight of the layer comprising a latex thus reducing runnability problems when using blade cutters to coat the substrate. Pigmenting the latex also improves the resulting print quality of print that may be applied to the laminate of the present invention. Suitable pigments include kaolin clay, delaminated clays, structured clays, calcined clays, alumina, silica, aluminosilicates, talc, calcium suflate, ground calcium carbonates, and precipitated calcium carboates. Other suitable pigments are disclosed, for example, in *Kirk-Othmer, Encyclopedia of Chemical Technology*, Third Edition, Vol. 17, pp. 798, 799, 815, 831–836, which is incorporated herein by reference. Preferably the pigment is selected form the group consisting of kaolin clay and conventional delaminated coating clay. An available delaminated coating clay is "HYDRAPRINT" slurry, supplied as a dispersion with a slurry solids content of about 68%. "HYDRAPRINT" slurry is a trademark of Huber. The layer comprising a latex may also contain other additives that are well known in the art to enhance the properties of the laminates comprising a latex, or are well known in the art to better enable laminates comprising a latex to be manufacture. By way of example, suitable additives include clays, dispersants, lubricants, defoamers, film-formers, antifoamers and crosslinkers. By way of example, "DISPEX N-40" is one suitable organic dispersant and comprises a 40% solids dispersion of sodium polycarboxylate. "DISPEX N-40" is a trademark of Allied Colloids. By way of example, "BERCHEM 4095" is one suitable lubricant and comprises 100% active coating lubricant based on modified glycerides. "BERCHEM 4095" is a trademark of Bercap. By way of example, "Foamaster DF-177NS" is one suitable defoamer. "Foamaster DF-122 NS" is a trademark of Henkel, In a preferred embodiment, the laminate comprises multiple layers that comprise a latex. The addition of multiple layers that comprise a latex improves the resulting print quality of print that may be applied to the laminate of the present invention.

The stock is moistened on the uncoated side after all of the printing and coating steps have been completed. In a typical forming operation, the web of paperboard stock is fed continuously from a roll through a scoring and cutting die to form the circular blanks which are scored and cut before being fed into position between the upper and lower die halves. The dies halves are heated as described above, to aid in the forming process. It has been found that best results are obtained if the upper die half and lower die half—particularly the surfaces thereof—are maintained at a temperature in the range of from about 250° F. to about 400° F., and most preferably at about 325° F.±25° F. These die temperatures have been found to facilitate the plastic deformation of paperboard in the rim areas if the paperboard has the preferred moisture levels. At these preferred die temperatures, the amount of heat applied to the blank is apparently sufficient to liberate the moisture within the blank under the rim and thereby facilitate the deformation of the fibers without overheating the blank and causing blisters from liberation of steam or scorching the blank material. It is apparent that the amount of heat applied to the paperboard will vary with the amount of time that the dies dwell in a position pressing the paperboard together. The preferred die temperatures are based on the usual dwell times encountered for normal production speeds of 30 to 60 pressings a minute, and commensurately higher or lower temperatures in the dies would generally be required for higher or lower production speeds, respectively.

As will be appreciated by one of skill in the art, the knock-outs are important for holding the paperboard blank on center during formation and for separating the finished product from the die halves, particularly during high speed operation. There is shown in FIGS. 14 through 17 a metal die press 48 including an upper die press assembly 50, commonly referred to as a punch die assembly and a lower die assembly 52. That is, assembly 52 includes a mounting plate 54, a segmented die 56 with a knock-out 58, a sidewall forming section 60, a rim forming portion 62 and a draw ring 64. It will be appreciated that metal die press 48 is ordinarily operated in an inclined state in accordance with the following United States Patents, the disclosures of which have been incorporated by reference into this application:

U.S. Pat. No. 5,249,946;

U.S. Pat. No. 4,832,676;

U.S. Pat. No. 4,721,500;

U.S. Pat. No. 4,609,140.

Figure 14:
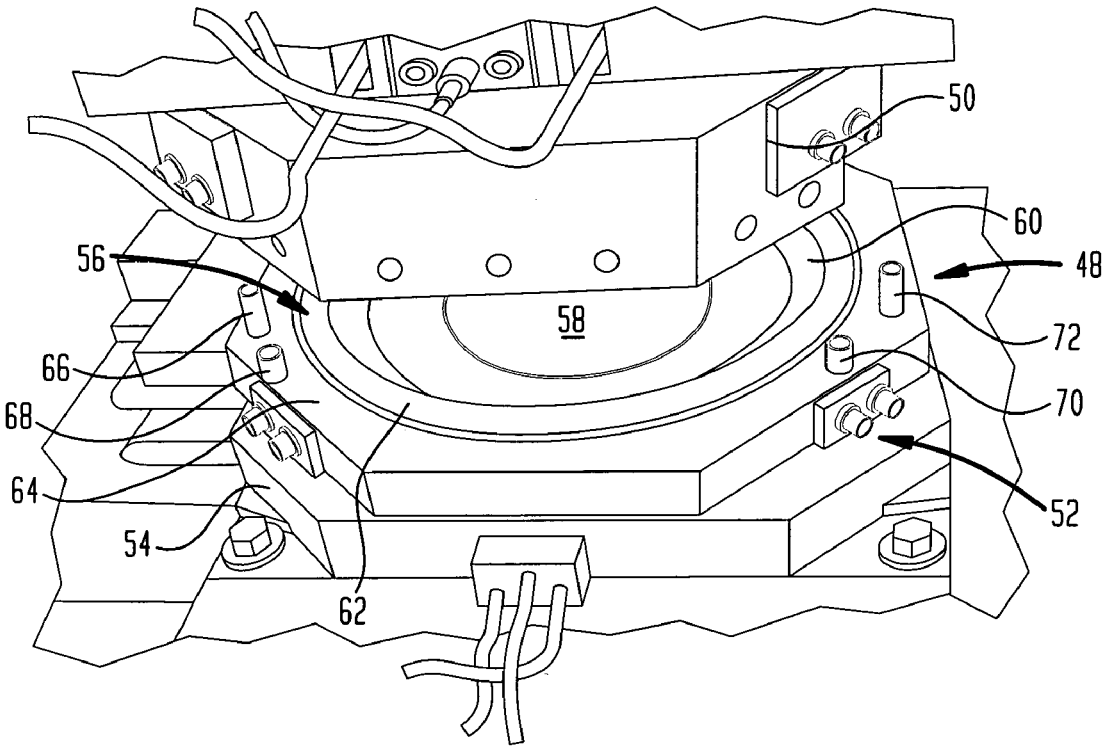
FIG. 14 is a schematic diagram of a matched die set forming press showing a rotating pin blank stop system.
Figure 15:
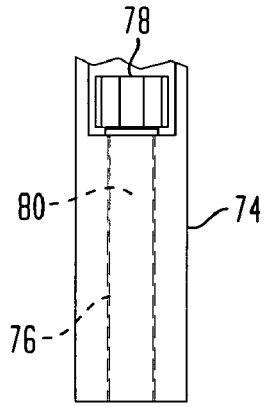
FIG. 15 is a drawing in section of a blank stop and retaining shoulder bolt which can be used in the apparatus of FIG. 14.

An important feature is a plurality of freely rotating stop pins 66, 68, 70 and 72 which may be constructed as shown in FIG. 15. Each pin 60–72 is constructed of steel or other suitable material and includes an elongated shaft 74 as well as a central bore 76. There is additionally provided a "counter bore" cavity 78 for receiving a retaining bolt. Preferably the bolt 80 is recessed within the cavity so that it will not interfere with operation of the apparatus. Bolts, preferably socket head shoulder bolts, are used to secure pins 66–72 to draw ring 64 of segmented die 56 as shown in FIG. 14. The bolts in central bore 76 are close in size to the bore diameter to prevent chatter and horizontal movement of the rotating pin blank stops but enough clearance is preferably allowed so that pins 66–72 are freely rotating about their rotating bolts. If so desired, a slight tension or bias can be provided to damp the motion of rotating pin blank stops 66–72, particularly when very heavy stock is employed in the forming process.

Figure 16:
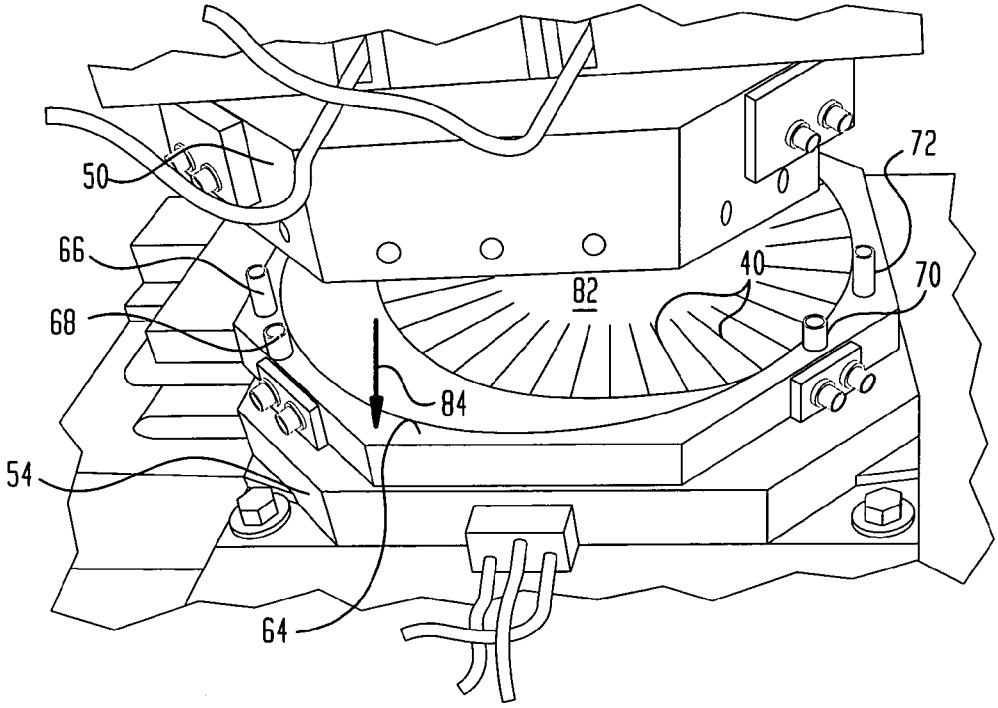
FIG. 16 is a schematic illustration of the apparatus of FIG. 14 showing a scored paperboard blank positioned for forming.

Referring to FIG. 16 there is shown a blank 82 provided with a plurality of scores 40 which are subsequently formed into pleats in the final product. That is to say, paperboard is gathered and pressed into pleats about scores 40. The pleats preferably are of the same thickness as adjacent regions of the plate and are substantially radially coextensive with the scores from which they are formed. Products in accordance with the present invention thus preferably include a plurality of circumferentially spaced densified regions extending radially over the sidewall and rim; most preferably including a plurality of layers of paperboard reformed into substantially integrated fibrous structures generally inseparable into their constituent layers and having a thickness generally equal to circumferentially adjacent areas of the rim. Preferably, the pleats include from 2 up to a maximum of 3 paperboard layers in some portions thereof as noted above.

As shown in FIG. 16 it would be appreciated that the rotating pin blank stops 66–72 are located on the forward portion of the lower die assembly 52, that is, the downstream production portion of the die, such that a gravity fed blank, such as blank 82, will contact the blank stops as shown. It could be seen that blanks 66–72 are in opposing relationship at the periphery at the lower die at a distance which is less than the maximum transverse dimension of the blank, in this case the diameter of blank 82 since it is a circular blank and that pins 68 and 70 are also located at a distance which is also less than the diameter of the blank inasmuch as the plate will move in the direction indicated by arrow 64 in the production process, it is important that the rotating pin blank stops do not interfere with the motion of the finished product.

Figure 17:
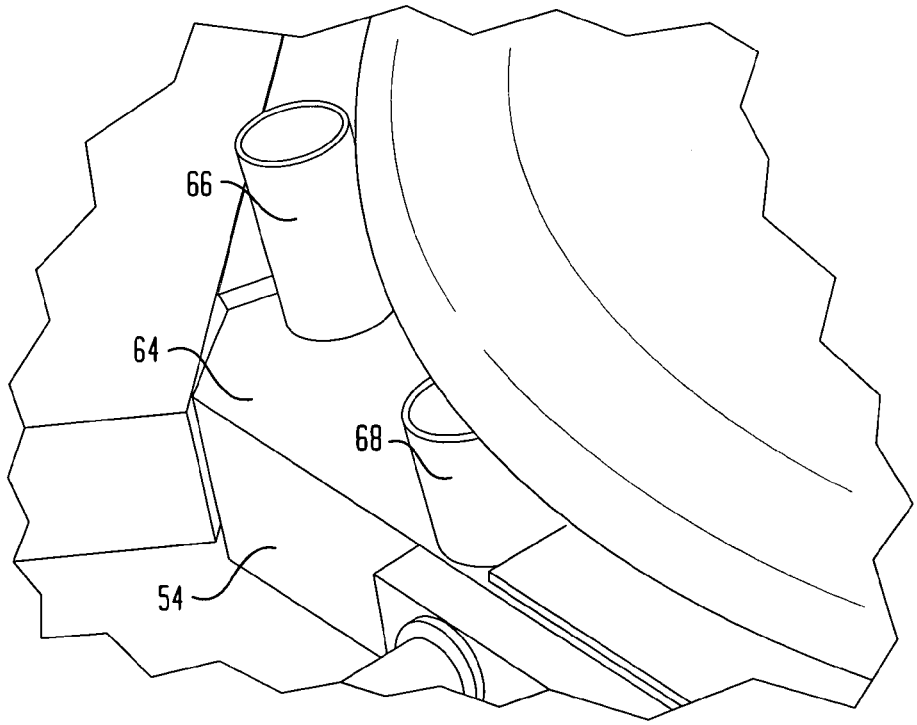
FIG. 17 is a schematic detail of the apparatus of FIG. 14 showing a finished product after forming.

After the blank is positioned as shown in FIG. 16, the top assembly 50 is lowered and the forming process is carried out in a conventional manner and the product is formed as shown in FIG. 17. It will be appreciated from FIG. 17 that the distances between the outer pin blank stops 66,72 is such that the finished product will readily slide between these pins, i.e., the distance is greater than or equal to the diameter of the finished container. It should also be noted as was further stated in the summary of the invention section above, that the product will travel over pins 68 and 70 which are typically of the same or lower height than pins 66 and 72 and are closer together than the maximum diameter of the finished container.

The deep dish disposable containers of the present invention may likewise be formed of a thermoplastic material. Suitable forming techniques include injection molding, injection blow molding, injection stretch molding and composite injection molding. Foamed material may be used if so desired. The containers may be thermoformed, thermoformed by the application of vacuum or thermoformed by a combination of vacuum and pressure.

The thermoplastic material may be a foamed or solid polymeric material selected from the group consisting of: polyamides, polyacrylates, polysulfones, polyetherketones, polycarbonates, acrylics, polyphenylene sulfides, acetals, cellulosic polymers, polyetherimides, polyphenylene ethers or oxides, styrene-maleic anhydride copolymers, styrene-acrylonitrile copolymers, polyvinylchlorides and mixtures thereof.

A preferred thermoplastic material comprises a foamed or solid polymeric material selected from the group consisting of: polyesters, polystyrenes, polypropylenes, polyethylenes and mixtures thereof.

In one embodiment, the container is made from a mineral-filled polypropylene sheet. The article may be made having a wall thickness from about 10 to about 80 mils and consists essentially of from about 40 to about 90 percent by weight of a polypropylene polymer, from about 10 to about 60 percent by weight of a mineral filler, from about 1 to about 15 percent by weight polyethylene, up to about 5 weight percent titanium dioxide and optionally including a basic organic or inorganic compound comprising the reaction product of an alkali metal or alkaline earth element with carbonates, phosphates, carboxylic acids as well as alkali metal and alkaline earth element oxides, hydroxides, or silicates and basic metal oxides, including mixtures of silicon dioxide with one or more of the following oxides: magnesium oxide, calcium oxide, barium oxide, and mixtures thereof.

A preferred wall thickness for plastic containers is from about 10 to about 50 mils; from about 15 to about 25 mils being typical. Mica is often a suitable filler.

Thermoforming is usually a preferred method of making the containers of the present invention from thermoplastic compositions. In the simplest form, thermoforming is the draping of a softened sheet over a shaped mold. In the more advanced form, thermoforming is the automatic high speed positioning of a sheet having an accurately controlled temperature into a pneumatically actuated forming station whereby the article's shape is defined by the mold, followed by trimming and regrind collection as is well known in the art. Still other alternative arrangements include the use of drape, vacuum, pressure, free blowing, matched die, billow drape, vacuum snap-back, billow vacuum, plug assist vacuum, reverse draw with plug assist, pressure bubble immersion, trapped sheet, slip, diaphragm, twin-sheet cut sheet, twin-sheet roll-fed forming or any suitable combinations of the above. Details are provided in J. L. Throne's book, *Thermoforming*, published in 1987 by Coulthard. Pages 21 through 29 of that book are incorporated herein by reference. Suitable alternate arrangements also include a pillow forming technique which creates a positive air pressure between two heat softened sheets to inflate them against a clamped male/female mold system to produce a hollow product. Metal molds are etched with patterns ranging from fine to coarse in order to simulate a natural or grain like texturized look. Suitable formed articles are trimmed in line with a cutting die and regrind is optionally reused since the material is thermoplastic in nature. Other arrangements for productivity enhancements include the simultaneous forming of multiple articles with multiple dies in order to maximize throughput and minimize scrap. The deep dish container of the present invention may be produced utilizing polymeric compositions filled with conventional inorganic fillers such as talc, mica, wollastonite and the like, wherein the polymer component is, for example, a polyester, a polystyrene homopolymer or copolymer, a polyolefin or one or more of the polymers noted above. While any suitable polymer may be used, polypropylene polymers which are suitable are preferably selected from the group consisting of isotactic polypropylene, and copolymers of propylene and ethylene wherein the ethylene moiety is less than about 10% of the units making up the polymer, and mixtures thereof. Generally, such polymers have a melt flow index from about 0.3 to about 4, but most preferably the polymer is isotactic polypropylene with a melt-flow index of about 1.5. In some preferred embodiments, the melt-compounded composition from which the articles are made may include polypropylene and optionally further includes a polyethylene component and titanium dioxide. A polyethylene polymer or component may be any suitable polyethylene such as HDPE, LDPE, MDPE, LLDPE or mixtures thereof and may be melt-blended with polypropylene if so desired.

The various polyethylene polymers referred to herein are described at length in the *Encyclopedia of Polymer Science & Engineering* (2d Ed.), Vol.6; pp: 383–522, Wiley 1986; the disclosure of which is incorporated herein by reference. HDPE refers to high density polyethylene which is substantially linear and has a density of generally greater that 0.94 up to about 0.97 g/cc. LDPE refers to low density polyethylene which is characterized by relatively long chain branching and a density of about 0.912 to about 0.925 g/cc. LLDPE or linear low density polyethylene is characterized by short chain branching and a density of from about 0.92 to about 0.94 g/cc. Finally, intermediate density polyethylene (MDPE) is characterized by relatively low branching and a density of from about 0.925 to about 0.94 g/cc.

Typically, in filled plastics the primary mineral filler is mica, talc, kaolin, bentonite, wollastonite, milled glass fiber, glass beads (solid or hollow), silica, or silicon carbide whiskers or mixtures thereof. We have discovered that polypropylene may be melt-compounded with acidic-type minerals such as mica, as well as inorganic materials and/or basic materials such as calcium carbonate, talc, barium sulfate, calcium sulfate, magnesium sulfate, clays, glass, dolomite, alumina, ceramics, calcium carbide, silica, pigments such as titanium dioxide based pigments and so on. Many of these materials are enumerated in the *Encyclopedia of Materials Science and Engineering*, Vol. #3, pp. 1745–1759, MIT Press, Cambridge, Mass. (1986), the disclosure of which is incorporated herein by reference. Combinations of fillers are preferred in some embodiments.

The invention has been described in detail hereinabove in connection with a particular embodiments which is not intended to limit in any way the scope of the present invention which is defined in the appended claims. It will be readily appreciated by one of skill in the art that the particular embodiments illustrated may be scaled up or down in size with the relative proportions shown herein or that product shapes such as square or rectangular with rounded corners, triangular, multi-sided, oval platters, polygonal platters with rounded corners and so forth may be formed in accordance with the present invention. In cases where the product shape is not round, scaling may be based upon the major or minor axis of the product shape or an average thereof instead of based on the product diameter, for example, as described in connection with Table 1 and FIGS. 3 and 4 above. So also, the bottom of the container may be crowned upward to minimize container rocking during use.

What is claimed is:

1. A rigid and strong deep dish disposable container prepared from a radially scored, substantially planar paperboard blank, the container having a substantially planar bottom portion, an upwardly extending sidewall portion and an outwardly extending flange portion, at least one of said upwardly extending sidewall portions and said outwardly extending flange portions being provided with a plurality of circumferentially spaced radially extending densified regions formed from a plurality of paperboard layers reformed into substantially integrated fibrous structures generally inseparable into their constituent layers having a thickness generally equal to adjacent areas of the sidewall or flange portions, said deep dish disposable container being provided with a height to diameter ratio of from about 0.1 to about 0.16 and a characteristic flange width to diameter ratio of at least about 0.04, wherein said densified regions extend over a profile distance corresponding to at least a portion of the length of the scores of the paperboard blank from which said container is formed, wherein said radially scored paperboard blank has from about 60 to about 90 radial scores and the deep dish container being further characterized by an SSI Rigidity of at least 500 grams at 0.5 inch deflection.

2. The deep dish disposable container according to claim 1, wherein said densified regions extend over a profile distance corresponding to at least about 50 percent of the length of the scores from which the container is formed.

3. The deep dish disposable container according to claim 2, wherein said densified regions extend over a profile distance corresponding to at least about 75 percent of the length of the scores from which the container is formed.

4. The deep dish disposable container according to claim 1, wherein said container further comprises a lip portion joined to said flange portion and extending downwardly therefrom.

5. The deep dish disposable container according to claim 1, wherein said plurality of circumferentially spaced radially extending densified regions are formed from 2 to 3 layers of paperboard reformed into substantially integrated fibrous structures with a thickness generally equal to adjacent areas of the sidewall or flange portions.

6. The deep dish disposable container according to claim 5, wherein said plurality of circumferentially spaced radially extending densified regions are formed from 2 up to a maximum of 3 layers of paperboard reformed into substantially integrated fibrous structures with a thickness generally equal to adjacent areas of the sidewall or flange portions.

7. The deep dish disposable container according to claim 1, wherein said radially scored paperboard blank has about 75 radial scores.

8. The deep dish disposable container according to claim 7, wherein the scores of said radially scored paperboard blank have a width of from about 0.01 inches to about 0.05 inches.

9. The deep dish disposable container according to claim 1, wherein the scores of said radially scored paperboard blank have a width of about 0.03 inches.

10. The deep dish disposable container according to claim 1 wherein said container has from about 0.015 inches to about 0.05 inches excess paperboard per score about said flange portion.

11. The deep dish disposable container according to claim 10, wherein said container has from about 0.025 inches to about 0.04 inches excess paperboard per score about said flange portion.

12. The deep dish disposable container according to claim 1, wherein said container has from about 50 percent to about 175 percent excess paperboard per score about said flange portion.

13. The deep dish disposable container according to claim 12, wherein said container has from about 90 percent to about 140 percent excess paperboard per score about said flange portion.

14. The deep dish disposable container according to claim 13, wherein said container has about 100 percent excess paperboard per score about said flange portion.

15. The deep dish disposable container according to claim 1, wherein said deep dish disposable container has a height to diameter ratio of from about 0.125 to about 0.135.

16. The deep dish disposable container according to claim 1, wherein the scores in the paperboard blank extend from the upper portion of the sidewall downwardly over at least about 75 percent of the height of the sidewall and terminate at a level substantially above said substantially planar bottom portion of said deep dish disposable container.

17. The deep dish disposable container according to claim 1, wherein the characteristic flange width to diameter ratio is from about 0.04 to about 0.12.

18. The deep dish disposable container according to claim 1, wherein the characteristic flange width to diameter ratio is at least about 0.05.

19. The deep dish disposable container according to claim 1, wherein said paperboard blank is provided with a substantially liquid-impervious coating comprising an inorganic pigment and a water-based, press-applied overcoat.

20. A rigid and strong deep dish disposable container prepared from a radially scored, substantially planar paperboard blank, at least one surface of said paperboard blank bearing a substantially liquid-impervious coating comprising an inorganic pigment and a water-based, press-applied overcoat, the container having a substantially planar bottom portion, an upwardly extending sidewall portion, an outwardly extending flange portion, and a lip downwardly extending therefrom, at least one of said upwardly extending sidewall portions and said outwardly extending flange portions being provided with a plurality of circumferentially spaced radially extending densified regions formed from two to three layers of paperboard reformed into substantially integrated fibrous structures generally inseparable into their constituent layers having a thickness generally equal to adjacent areas of the sidewall or flange portions, wherein the ratio of the height to diameter of said container is from at least about 0.1 to about 0.16, the ratio of the length of said downwardly extending lip to the diameter of said deep dish disposable container is from about 0.010 to about 0.030 and wherein said densified regions extend over a profile distance corresponding to at least a portion of the length of the scores of the paperboard blank from which said container is formed, the deep dish container being further characterized by an SSI Rigidity of at least 500 grams at 0.5 inch deflection.

21. The deep dish disposable container according to claim 20, wherein said densified regions extend over a profile distance corresponding to at least about 50 percent of the length of the scores from which the container is formed.

22. The deep dish disposable container according to claim 21, wherein said densified regions extend over a profile distance corresponding to at least about 75 percent of the length of the scores from which the container is formed.

23. The deep dish disposable container according to claim 20, wherein said container further comprises a lip portion joined to said flange portion and extending downwardly therefrom.

24. The deep dish disposable container according to claim 20, wherein said plurality of circumferentially spaced radially extending densified regions are formed from 2 up to a maximum of 3 layers of paperboard in some portions reformed into substantially integrated fibrous structures with a thickness generally equal to adjacent areas of the sidewall or flange portions.

25. The deep dish disposable container according to claim 20, wherein said radially scored paperboard blank has from about 50 to about 100 radial scores.

26. The deep dish disposable container according to claim 25, wherein said radially scored paperboard blank has from about 60 to about 90 radial scores.

27. The deep dish disposable container according to claim 26, wherein said radially scored paperboard blank has about 75 radial scores.

28. The deep dish disposable container according to claim 25, wherein the scores of said radially scored paperboard blank have a width of from about 0.01 inches to about 0.05 inches.

29. The deep dish disposable container according to claim 28, wherein the scores of said radially scored paperboard blank have a width of about 0.03 inches.

30. The deep dish disposable container according to claim 25 wherein said container has from about 0.015 inches to about 0.05 inches excess paperboard per score about said flange portion.

31. The deep dish disposable container according to claim 30, wherein said container has from about 0.025 inches to about 0.04 inches excess paperboard per score about said flange portion.

32. The deep dish disposable container according to claim 20, wherein said container has from about 50 percent to about 175 percent excess paperboard per score about said flange portion.

33. The deep dish disposable container according to claim 32, wherein said container has from about 90 percent to about 140 percent excess paperboard per score about said flange portion.

34. The deep dish disposable container according to claim 33, wherein said container has about 100 percent excess paperboard per score about said flange portion.

35. The deep dish disposable container according to claim 20, wherein said deep dish disposable container has a height to diameter ratio of from about 0.125 to about 0.135.

36. The deep dish disposable container according to claim 20, wherein the scores in the paperboard blank extend from the upper portion of the sidewall downwardly over at least about 75 percent of the height of the sidewall and terminate at a level substantially above said substantially planar bottom portion of said deep dish disposable container.

37. A deep dish disposable container formed of paper including a substantially planar bottom portion, an upwardly extending sidewall integrally formed with said substantially planar bottom portion and a flanged portion projecting outwardly from the upper extremity of said sidewall portion, wherein said upwardly extending sidewall defines an angle of from about 10° to about 40° from a vertical perpendicular to said substantially planar bottom portion and said outwardly projecting flange portion defines an angle of from about −10° to about +15° with a horizontal parallel to said substantially planar bottom portion and wherein further, said deep dish disposable container has a height to diameter ratio of from about 0.1 to about 0.16, the deep dish container being further characterized by an SSI Rigidity of at least 500 grams at 0.5 inch deflection.

38. The deep dish disposable container according to claim 37, wherein said deep dish disposable container has a height to diameter ratio of from about 0.125 to about 0.135.

39. The deep dish disposable container according to claim 37, wherein said upwardly extending sidewall defines an angle of about 30° from a vertical perpendicular to said substantially planar bottom portion.

40. The deep dish disposable container according to claim 39, wherein said outwardly projecting flange portion defines an angle of about 5° with a horizontal parallel to said substantially planar bottom portion.

41. The deep dish disposable container according to claim 37, wherein said substantially planar bottom portion is joined to said upwardly extending sidewall by way of a first arcuate transition section defining a first radius of curvature, wherein the ratio of said first radius of curvature to the diameter of said deep dish disposable container is from about 0.035 to about 0.075.

42. The deep dish disposable container according to claim 41, wherein the ratio of said first radius of curvature to the diameter of said deep dish disposable container is about 0.05.

43. The deep dish disposable container according to claim 41, wherein said upwardly extending sidewall is joined to said flange portion by a second arcuate transition section defining a second radius of curvature wherein the ratio of said second radius of curvature to the diameter of said deep dish disposable container is from about 0.015 to about 0.045.

44. The deep dish disposable container according to claim 37, further comprising a lip portion joined to said flange portion and extending downwardly therefrom.

45. The deep dish disposable container according to claim 37, wherein said deep dish disposable container has a diameter between about 9 and about 10 inches and height from about 1 to about 1.5 inches.

46. The deep dish disposable container according to claim 37, formed from a radially scored, substantially planar paperboard blank, wherein said container has a substantial excess of paperboard per score such that during forming, said upwardly extending sidewall and said flange portions are provided with a plurality of circumferentially spaced, radially extending densified regions formed from a plurality of paperboard layers reformed into substantially integrated fibrous structures generally inseparable into their constituent layers having a thickness generally equal to adjacent areas of the sidewall and flange portions.

47. The deep dish disposable container according to claim 46, wherein said radially scored paperboard blank has from about 60 to about 90 radial scores.

48. The deep dish disposable container according to claim 47, wherein the scores of said radially scored paperboard blank have a width of from about 0.01 inches to about 0.04 inches.

49. The deep dish disposable container according to claim 46, wherein the scores of said radially scored paperboard blank have a width of from about 0.01 inches to about 0.04 inches.

50. The deep dish disposable container according to claim 49, wherein the scores of said radially scored paperboard blank have a width of about 0.03 inches.

51. The deep dish disposable container according to claim 46, wherein said container has from about 0.015 inches to about 0.05 inches excess paperboard per score about said flange portion.

52. The deep dish disposable container according to claim 51, wherein said container has from about 0.025 inches to about 0.04 inches excess paperboard per score about said flange portion.

53. The deep dish disposable container according to claim 46, wherein said container has from about 50 percent to about 175 percent excess paperboard per score about said flange portion.

54. The deep dish disposable container according to claim 46, wherein said container has from about 90 percent to about 140 percent excess paperboard per score about said flange portion.

55. The deep dish disposable container according to claim 54, wherein said container has about 100 percent excess paperboard per score about said flange portion.

56. The deep dish disposable container according to claim 46, wherein said deep dish disposable container has a height to diameter ratio of from about 0.125 to about 0.135.

57. The deep dish disposable container according to claim 46, wherein the scores of the paperboard blank extend from the upper portion of the sidewall downwardly over at least about 50 percent of the height of the sidewall and terminate at a level substantially above said substantially planar bottom portion of said deep dish disposable container.

58. The deep dish disposable container according to claim 46, wherein the scores in the paperboard blank extend from the upper portion of the sidewall downwardly over at least about 75 percent of the height of the sidewall and terminate at a level substantially above said substantially planar bottom portion of said deep dish disposable container.

59. A rigid and strong deep dish disposable container prepared from a radially scored, substantially planar paperboard blank, the container having a substantially planar bottom portion, an upwardly extending sidewall portion, an outwardly extending flange portion, and a lip downwardly extending therefrom, at least one of said upwardly extending sidewall portions and said outwardly extending flange portions being provided with a plurality of circumferentially spaced radially extending densified regions formed from two to three layers of paperboard reformed into substantially integrated fibrous structures generally inseparable into their constituent layers having a thickness generally equal to adjacent areas of the sidewall or flange portions, wherein the ratio of the height to diameter of said container is from at least about 0.1 to about 0.16, the ratio of the length of said downwardly extending lip to the diameter of said deep dish disposable container is from about 0.010 to about 0.030 and wherein said densified regions extend over a profile distance corresponding to at least about 50 percent of the length of the scores of the paperboard blank from which said container is formed, the deep dish container being further characterized by an SSI Rigidity of at least 500 grams at a 0.5 inch deflection.

60. The deep dish disposable container according to claim 59, wherein said densified regions extend over a profile distance corresponding to at least about 75 percent of the length of the scores from which the container is formed.

61. The deep dish disposable container according to claim 59, wherein said container further comprises a lip portion joined to said flange portion and extending downwardly therefrom.

62. The deep dish disposable container according to claim 59, wherein said radially scored paperboard blank has from about 50 to about 100 radial scores.

63. The deep dish disposable container according to claim 62, wherein said radially scored paperboard blank has from about 60 to about 90 radial scores.

64. The deep dish disposable container according to claim 63, wherein said radially scored paperboard blank has about 75 radial scores.

65. The deep dish disposable container according to claim 62, wherein the scores of said radially scored paperboard blank have a width of from about 0.01 inches to about 0.05 inches.

66. The deep dish disposable container according to claim 65, wherein the scores of said radially scored paperboard blank have a width of about 0.03 inches.

67. The deep dish disposable container according to claim 66, wherein said container has from about 0.015 inches to about 0.05 inches excess paperboard per score about said flange portion.

68. The deep dish disposable container according to claim 67, wherein said container has from about 0.025 inches to about 0.04 inches excess paperboard per score about said flange portion.

69. The deep dish disposable container according to claim 59, wherein said container has from about 50 percent to about 175 percent excess paperboard per score about said flange portion.

70. The deep dish disposable container according to claim 69, wherein said container has from about 90 percent to about 140 percent excess paperboard per score about said flange portion.

71. The deep dish disposable container according to claim 70, wherein said container has about 100 percent excess paperboard per score about said flange portion.

72. The deep dish disposable container according to claim 59, wherein said deep dish disposable container has a height to diameter ratio of from about 0.125 to about 0.135.

73. The deep dish disposable container according to claim 59, wherein the scores in the paperboard blank extend from the upper portion of the sidewall downwardly over at least about 75 percent of the height of the sidewall and terminate at a level substantially above said substantially planar bottom portion of said deep dish disposable container.

74. A rigid and strong deep dish disposable container prepared from a radially scored, substantially planar paperboard blank, the container having a substantially planar bottom portion, an upwardly extending sidewall portion and an outwardly extending flange portion, at least one of said upwardly extending sidewall portions and said outwardly extending flange portions being provided with a plurality of circumferentially spaced radially extending densified regions formed from a plurality of paperboard layers reformed into substantially integrated fibrous structures generally inseparable into their constituent layers having a thickness generally equal to adjacent areas of the sidewall or flange portions, said deep dish disposable container being provided with a height to diameter ratio of from about 0.1 to about 0.16 and a characteristic flange width to diameter ratio of at least about 0.04, wherein said densified regions extend over a profile distance corresponding to at least a portion of the length of the scores of the paperboard blank from which said container is formed, the deep dish container being further characterized by an SSI Rigidity of at least 500 grams at 0.5 inch deflection.

* * * * *